US009847598B2

(12) United States Patent
Lim et al.

(10) Patent No.: US 9,847,598 B2
(45) Date of Patent: Dec. 19, 2017

(54) METHOD, SYSTEM AND DEVICES FOR INTERCONNECTING A PLURALITY OF DEVICES

(71) Applicant: 3M INNOVATIVE PROPERTIES COMPANY, St. Paul, MN (US)

(72) Inventors: Chin Hua Lim, Ang Mo Kio (SG); Saujit Bandhu, Anchorvale (SG); Yew Meng Wu, Ang Mo Kio (SG)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 13/964,144

(22) Filed: Aug. 12, 2013

(65) Prior Publication Data

US 2013/0344728 A1 Dec. 26, 2013

Related U.S. Application Data

(63) Continuation of application No. 13/131,297, filed as application No. PCT/US2009/066298 on Dec. 2, 2009, now Pat. No. 8,506,317.

(Continued)

(51) Int. Cl.

*H01R 4/50* (2006.01)
*H01R 13/627* (2006.01)

(Continued)

(52) U.S. Cl.

CPC ..... *H01R 13/6271* (2013.01); *H01R 9/032* (2013.01); *H01R 12/712* (2013.01); *H01R 13/6585* (2013.01); *H01R 13/6594* (2013.01); *H01R 13/6658* (2013.01); *H01R 23/688* (2013.01); *H01R 24/60* (2013.01); *H01R 43/26* (2013.01); *H01R 13/512* (2013.01); *H01R 13/582* (2013.01); *H01R 13/6335* (2013.01); *H01R 13/6593* (2013.01); *H01R 2107/00* (2013.01); *Y10T 29/49208* (2015.01)

(58) Field of Classification Search

CPC ..... H01R 13/6271; H01R 12/712; H01R 13/6594; H01R 13/6585; H01R 43/26; H01R 13/582; H01R 13/6335; H01R 13/512; H01R 2107/00; H01R 13/6593; H01R 9/032; H01R 24/60; H01R 23/688; H01R 13/6658; Y10T 29/49208

USPC ..... 439/345, 372, 352, 697.08, 607.35, 378, 439/92

See application file for complete search history.

(56) References Cited

U.S. PATENT DOCUMENTS 4,992,052 A 2/1991 Verhoeven
5,171,161 A * 12/1992 Kachlic ..... 439/352

(Continued)

FOREIGN PATENT DOCUMENTS

WO WO 2006/014541 2/2006

*Primary Examiner* — Jean F Duverne
(74) *Attorney, Agent, or Firm* — Robert S. Moshrefzadeh

(57) ABSTRACT

An electrical connector is disclosed that includes an insulative housing having a mating face at one end, a rear face at another end, a mating slot at the mating face for receiving a complementary connector, a first set of contacts mounted in a first set of channels incorporated at a top of the insulative housing and a second set of contacts mounted in a second set of channels incorporated at a bottom of the insulative housing, and a shielding device located between the first set of contacts and the second set of contacts.

20 Claims, 21 Drawing Sheets

Related U.S. Application Data

(60) Provisional application No. 61/145,004, filed on Jan. 15, 2009, provisional application No. 61/144,607, filed on Jan. 14, 2009, provisional application No. 61/119,774, filed on Dec. 4, 2008.

(51) Int. Cl.

| | |
|---|---|
| ***H01R 9/03*** | (2006.01) |
| ***H01R 13/66*** | (2006.01) |
| ***H01R 12/50*** | (2011.01) |
| ***H01R 24/60*** | (2011.01) |
| ***H01R 43/26*** | (2006.01) |
| ***H01R 13/6585*** | (2011.01) |
| ***H01R 13/6594*** | (2011.01) |
| ***H01R 12/71*** | (2011.01) |
| *H01R 13/512* | (2006.01) |
| *H01R 13/58* | (2006.01) |
| *H01R 13/633* | (2006.01) |
| *H01R 107/00* | (2006.01) |
| *H01R 13/6593* | (2011.01) |

(56) References Cited

U.S. PATENT DOCUMENTS

| | | | | | |
|---|---|---|---|---|---|
| 5,201,670 | A * | 4/1993 | Watanabe et al. | 439/372 | |
| 5,474,472 | A * | 12/1995 | Niwa et al. | 439/607.08 | |
| 5,624,271 | A * | 4/1997 | Childs et al. | 439/352 | |
| 5,637,010 | A * | 6/1997 | Jost et al. | 439/352 | |
| 5,915,987 | A * | 6/1999 | Reed et al. | 439/352 | |
| 6,093,046 | A * | 7/2000 | Chiou et al. | 439/378 | |
| 6,227,880 | B1 | 5/2001 | Zhu et al. | | |
| 6,250,935 | B1 * | 6/2001 | Mochizuki | H01R 23/6873 | 439/108 |
| 6,250,944 | B1 | 6/2001 | Jones | | |
| 6,267,624 | B1 * | 7/2001 | Wu et al. | 439/607.35 | |
| 6,273,757 | B1 * | 8/2001 | David | H01R 23/6873 | 439/607.13 |
| 6,319,061 | B1 | 11/2001 | Chen et al. | | |
| 6,503,102 | B1 | 1/2003 | Zhang et al. | | |
| 6,835,091 | B2 * | 12/2004 | Oleynick | H01R 12/716 | 439/541.5 |
| 6,979,228 | B2 * | 12/2005 | Zhang | H01R 12/721 | 439/660 |
| 6,986,681 | B2 | 1/2006 | Tsai | | |
| 7,081,017 | B2 * | 7/2006 | Shuey | H01R 13/65802 | 439/607.23 |
| 7,198,519 | B2 | 4/2007 | Regnier et al. | | |
| 7,207,836 | B2 * | 4/2007 | Tsai | H01R 13/5804 | 439/541.5 |
| 7,311,532 | B1 * | 12/2007 | Bippus et al. | 439/108 | |
| 7,442,089 | B2 * | 10/2008 | Regnier | H01R 13/26 | 439/637 |
| 7,445,505 | B1 | 11/2008 | Yi | | |
| 8,187,019 | B2 * | 5/2012 | Reed | H01R 9/038 | 439/345 |
| 2005/0003696 | A1 * | 1/2005 | Shirk | H01R 13/62933 | 439/352 |
| 2006/0141843 | A1 | 6/2006 | Huang et al. | | |
| 2006/0148300 | A1 | 7/2006 | Huang et al. | | |
| 2006/0189197 | A1 | 8/2006 | Reed et al. | | |
| 2009/0291584 | A1 * | 11/2009 | Wu | H01R 13/6275 | 439/345 |
| 2010/0041257 | A1 * | 2/2010 | Beck et al. | 439/108 | |

* cited by examiner

METHOD, SYSTEM AND DEVICES FOR INTERCONNECTING A PLURALITY OF DEVICES

TECHNICAL FIELD

The present invention relates to a method, a system and devices for interconnecting a plurality of devices, more particularly a plurality of high speed data storage devices.

BACKGROUND

It is common these days to find information available in digital format. As technology advances, man's desire progresses and man's expectations increase from content availability to content presentation and quality. While information in a textual form was able to satisfy in the early days, the same information is now expected to be delivered in a fast seamless multimedia form having massive text coupled with high quality stereo, pictures and videos. Thus, there is a demand to have more high speed large capacity data storage devices within an electronic device to store the huge increase in the amount of information used.

Together with this demand for more data storage devices is man's expectation that the electronic device which houses these data storage devices remains compact and portable. Thus, the space within the electronic device is a premium and the footprint of each component and/or connector defined on the printed circuit board within the electronic device has little room for expansion.

The present invention is directed to a method, a system and devices for interconnecting a plurality of devices, more particularly a plurality of high speed data storage devices, without substantially increasing the existing footprint of the component and/or connector on the printed circuit board within the electronic device.

SUMMARY

It would be desirable to provide a method, a system or devices which can interconnect more data storage devices without substantially increasing the connector footprint on the printed circuit board. It would also be desirable to provide devices which can interconnect high speed data storage devices with minimum cross-talk errors.

In accordance with one embodiment of the present invention, there is provided an electrical connector comprising an insulative housing having a top, a bottom and two sidewalls interconnecting to form a mating face at one end and a rear face at another end and whereby there is a mating slot formed at the mating face for receiving a complementary connector; a first set of contacts mounted in a first set of channels incorporated at the top of the insulative housing and a second set of contacts mounted in a second set of channels incorporated at the bottom of the insulative housing; and a shielding device located between the first set of contacts and the second set of contacts.

In accordance with another embodiment of the present invention, there is provided a cable assembly comprising at least one electrical connector as described earlier, a cable housing having a top cover and a bottom cover whereby the top cover is coupled to the bottom cover by a coupling device; and at least one printed circuit board enclosed within the cable housing, wherein each printed circuit board is coupled to an electrical connector as described earlier at one end and to at least one shielded cable at another end.

In accordance with another embodiment of the present invention, there is provided an electrical connector comprising an insulative body having a top, a bottom, a front face and a rear face; a plurality of tongues, each tongue having a top tongue surface and a bottom tongue surface, extending from the front face in a direction away from the insulative body; one set of terminals mounted in one set of tongue slots incorporated at the top tongue surface of each tongue and another set of terminals mounted in another set of tongue slots incorporated at the bottom tongue surface of each tongue, wherein the tongue slots incorporated at the bottom tongue surface are aligned to the tongue slots incorporated at the top tongue surface; and a plurality of lateral slots in the insulative body configured to receive at least one attachment device.

In accordance with another embodiment of the present invention, there is provided an electrical connector comprising an insulative body having a top, a bottom, a front face and a rear face; a first tongue having a first top tongue surface and a first bottom tongue surface, extending from the front face in a direction away from the insulative body; a second tongue having a second top tongue surface and a second bottom tongue surface, extending from the front face in a direction away from the insulative body; a plurality of rear face extensions extending from the rear face in a direction away from the insulative body; a first set of terminals mounted in a first set of tongue slots incorporated at the first bottom tongue surface, a second set of terminals mounted in a second set of tongue slots incorporated at the first top tongue surface, wherein the second set of tongue slots are aligned to the first set of tongue slots; a third set of terminals mounted in a third set of tongue slots incorporated at the second bottom tongue surface, a fourth set of terminals mounted in a fourth set of tongue slots incorporated at the second top tongue surface, wherein the fourth set of tongue slots are aligned to the third set of tongue slots; whereby each terminal in the first, second, third and fourth set of terminals further comprises a mating portion, a terminal tail portion and a body portion connecting the mating portion to the terminal tail portion, and the width of the mating portion is greater than the width of the terminal tail portion; and a plurality of lateral slots in the insulative body configured to receive at least one attachment device.

In accordance with another embodiment of the present invention, there is provided a method of interconnecting multiple devices comprising the steps of stacking a plurality of connectors one above the other, wherein at least the bottom connector is a board mount connector; aligning a first set of terminals in each connector to a second set of terminals in each connector; shielding the signals of the first set of terminals and the signals of the second set of terminals from each other by incorporating a shielding device between the first set of terminals and the second set of terminals; and tapering the terminals at the board mount end of the connectors.

The invention further includes any alternative combination of parts or features mentioned herein or shown in the accompanying drawings. Known equivalents of these parts or features which are not expressly set out are nevertheless deemed to be included.

BRIEF DESCRIPTION OF THE DRAWINGS

An exemplary form of the present invention will now be described with reference to the accompanying drawings in which.

While the above-identified drawing figures set forth several embodiments of the invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale. Like reference numbers have been used throughout the figures to denote like parts.

DETAILED DESCRIPTION

There are many ways to accommodate the increase in demand for high speed data storage capacity within an electronic device including increasing the storage capacity of the data storage device or increasing the number of data storage devices in the electronic device or increasing both the storage capacity and the number of data storage devices in the electronic device.

Currently, a small form connector is able to connect only up to four data storage devices. This is because the number of contacts (also referred to as terminals) within the connector is limited, conventionally to about 26 of them. If there is a need to have more data storage devices in the electronic device, additional connectors would have to be installed or the width of the connector would have to be increased to accommodate more contacts in the connector resulting in taking up more real estate on the printed circuit board (hereafter referred to as PCB). For some small electronic devices, it may not be possible to allocate more real estate (which is limited) on the PCB for the installation of additional connectors.

As the size of the connector is small, the contacts are naturally very fine, mostly of the width of 0.2 mm to 0.4 mm. Reducing the width of the contacts to accommodate more contacts within the same physical size of the connector may result in signal loss due to poor mating of the contacts in the connector on the data storage device and the contacts in the connector on the PCB. In additional, due to the closeness of one contact to another contact in a small form connector, the likelihood of cross-talk error between contacts increases as the speed of the data exchange increases.

It would be desirable to have a method, a system or devices which can interconnect more data storage devices without substantially increasing the connector footprint on the PCB. It would also be desirable to have devices which can interconnect high speed data storage devices with minimum cross-talk errors.

Figure 1:
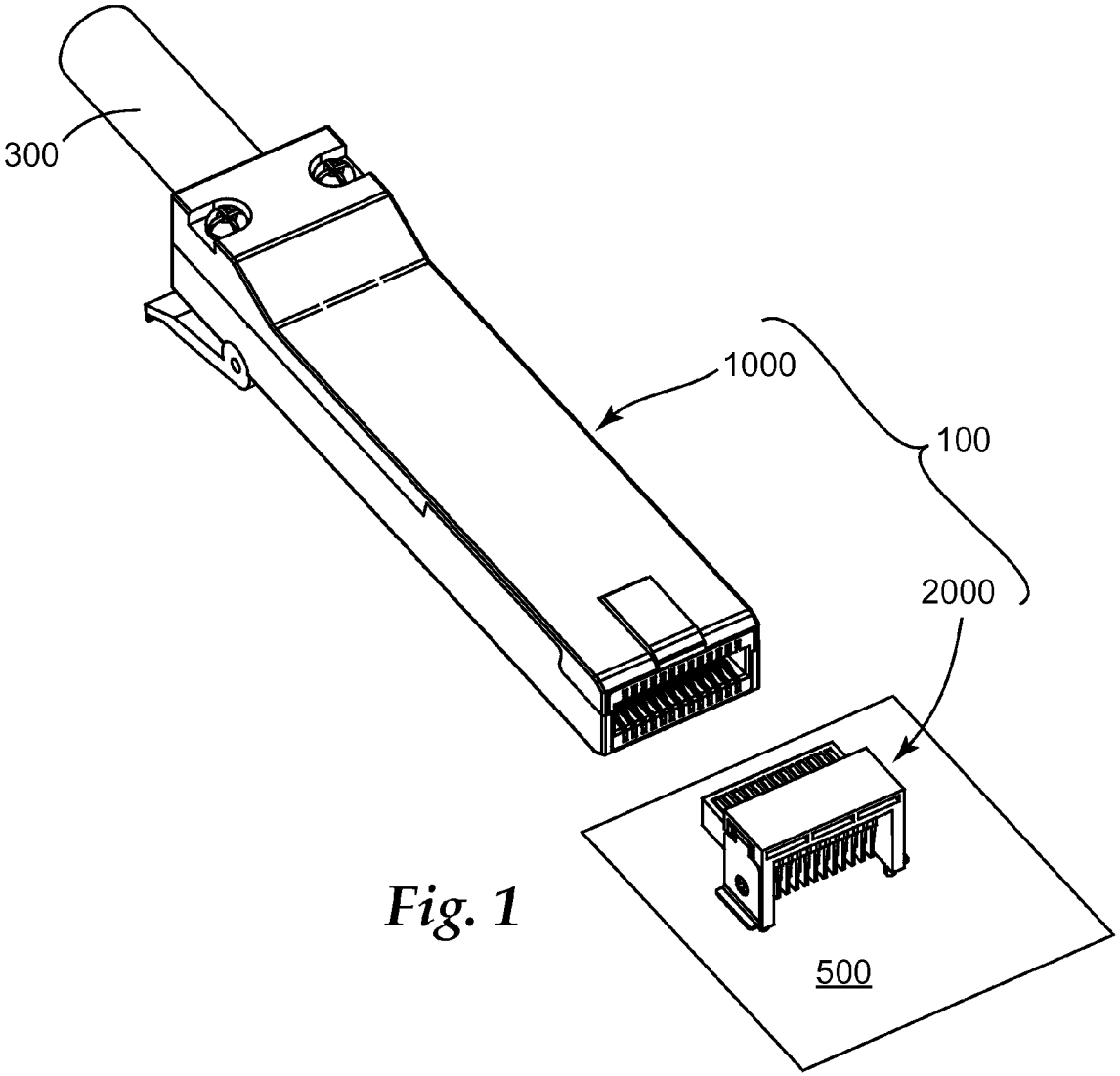
FIG. 1 is a perspective view of an exemplary system of the present invention comprising a high density cable assembly and a high density connector mounted on a printed circuit board.

FIG. 1 shows an exemplary system 100 of the present invention comprising a high density cable assembly 1000 and a high density connector 2000 mounted on a PCB 500.

Figure 2A:
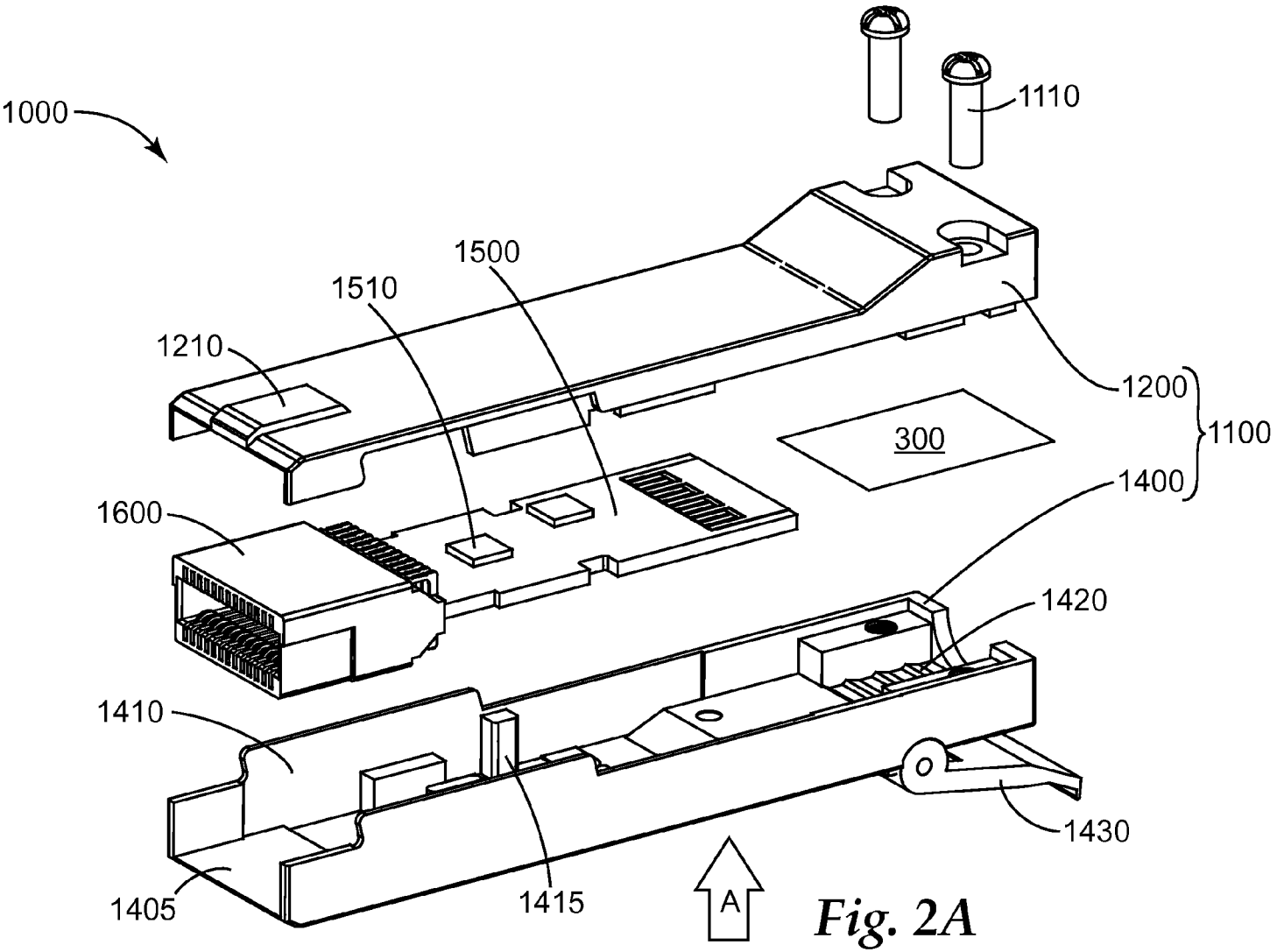
FIG. 2A shows an exploded view of the high density cable assembly of FIG. 1.
Figure 2B:
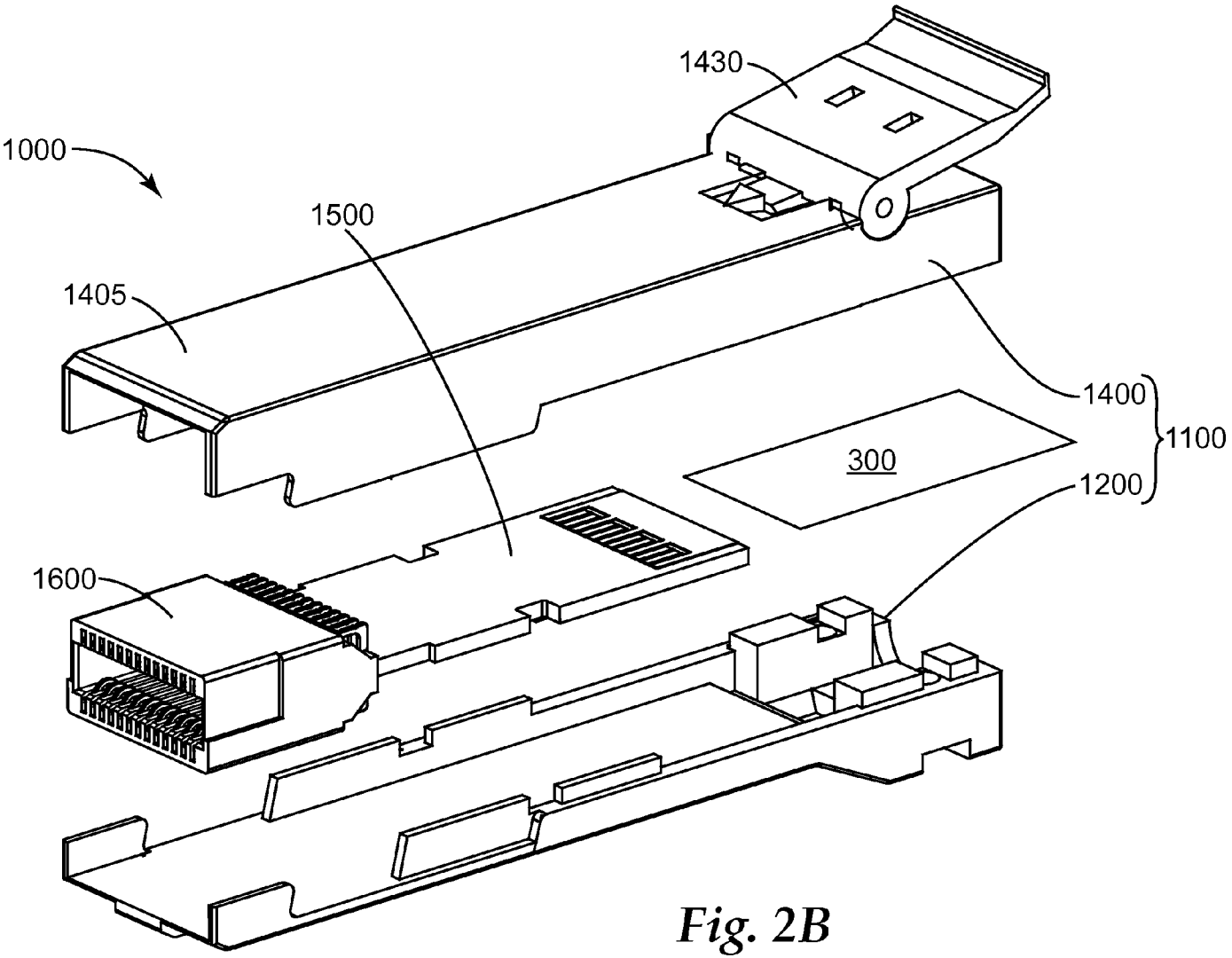
FIG. 2B shows the high density cable assembly of FIG. 2A viewed from the direction as indicated by arrow A.

With reference to FIGS. 2A and 2B, an embodiment of the high density cable assembly 1000 comprises a cable housing 1100 enclosing a PCB 1500 coupled to a high density cable connector 1600 at one end and a shielded cable 300 at another end, wherein the cable housing 1100 further comprises a top cover 1200 and a bottom cover 1400, whereby the top cover 1200 may be coupled to the bottom cover 1400 by a coupling device. The coupling device may include, but not limited to, a plurality of screws 1110 as shown in FIG. 2A.

The PCB 1500 may be of flexible or rigid substrate. In one embodiment, the PCB 1500 may include a plurality of equalization devices 1510 which may be of active or passive nature and may be used to control the amplitude of the electrical signals to stay within a predefined range. Optionally, the equalization devices 1510, if they are of active nature, may be used for other forms of signal equalization such as, but not limited to, signal regeneration.

Preferably, the top cover 1200 and the bottom cover 1400 of the cable housing 1100 are metallic. In this case, the high density cable assembly 1000 can be grounded when the cable housing 1100 is engaged with complementary parts which have a ground connection such as a metal cage (not shown but known to a person skilled in the art) enclosing the high density connector 2000 on the PCB 500 or a plurality of braided cables (not shown) in the shielded cable 300. Additionally, the metallic cable housing 1100 can shield the PCB 1500, the high density cable connector 1600 and the equalization devices 1510 within the cable housing 1100 from external electromagnetic interference (EMI).

In one embodiment, on one side of the top cover 1200, it may further comprise a plurality of assembly guides 1210 to facilitate the mating of the high density cable assembly 1000 with a metal cage (not shown) housing the high density connector 2000 on the PCB 500 of an electronic device when in use. Similar in function to the cable housing 1100, the metal cage provides EMI shielding for the high density connector 2000 from the external environment. It is worthwhile to note that the assembly guides 1210 may vary in number, shape and form and are not limited to the number, shape and form as illustrated in FIG. 2A.

In another embodiment, the bottom cover 1400 further comprises a base 1405, a plurality of walls 1410 extending vertically from the base 1405 and a plurality of restricting devices to restrict the movement of the PCB 1500 within the cable housing 1100. In one embodiment, the restricting device may be a plurality of protrusions 1415 extending from the walls 1410. In another embodiment, the restricting device may be a plurality of teeth 1420 extending from one side of the base 1405 of the bottom cover 1400. When the top cover 1200 is coupled to the bottom cover 1400, the teeth 1420 bite into the shielded cable 300, further preventing any movement of the PCB 1500 within the cable housing 1100. It is worthwhile to note that the restricting devices may vary in number, shape and form and are not limited to the number, shape and form as illustrated in FIG. 2A.

In another embodiment, on another side of the base 1405 of the bottom cover 1400, it may further comprise a latching mechanism 1430 which may be used to couple/de-couple the high density cable assembly 1000 to/from the metal cage (not shown) housing the high density connector 2000 on a PCB 500 of an electronic device. Additional exemplary embodiments of latch mechanisms that can be used in a high density cable assembly according to an aspect of the present invention are described in detail below with respect to FIGS. 12A-19.

Figure 3A:
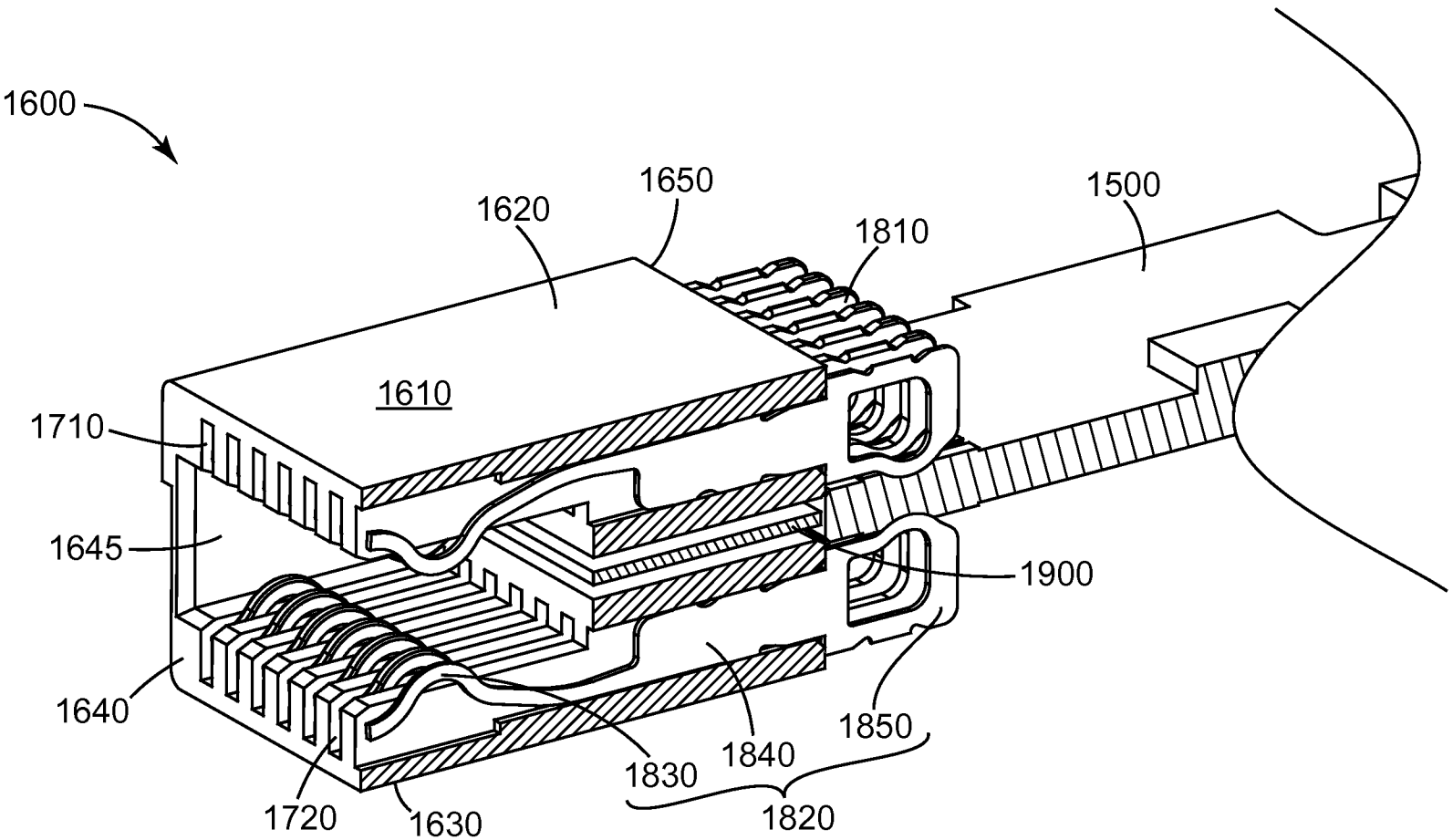
FIG. 3A shows a perspective cut-away close-up view of an embodiment of a high density cable connector.
Figure 3B:
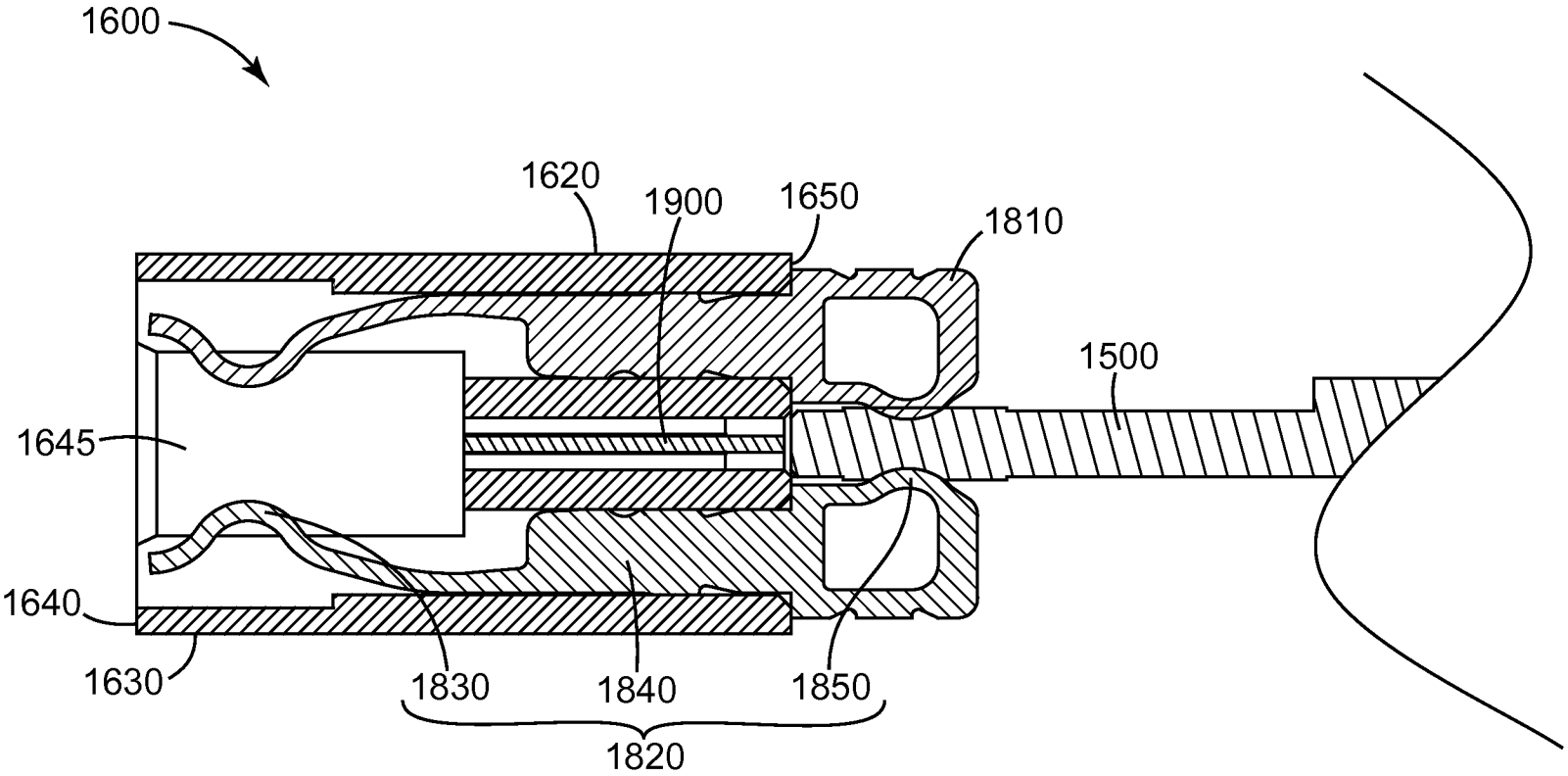
FIG. 3B shows a vertical cross-sectional view of the high density cable connector of FIG. 3A.

FIG. 3A shows a perspective cut-away close-up view of an embodiment of a high density cable connector 1600 while FIG. 3B shows a vertical cross-sectional view of the high density cable connector 1600 of FIG. 3A. While a socket is used to explain and illustrate the high density cable connector 1600, it is possible to replace the socket with a header and/or use a hybrid connector that functions both as a socket and a header, without changing the spirit of the invention.

With reference to FIGS. 3A and 3B, the high density cable connector 1600 comprises an insulative housing 1610, preferably formed from a dielectric material, having a top 1620, a bottom 1630 and two sidewalls interconnecting to form a mating face 1640 at one end and a rear face 1650 at another end. At the mating face 1640, there is a mating slot 1645 formed for receiving a complementary connector such as the high density connector 2000. Extending from, at or near the mating face 1640 to the rear face 1650, the insulative housing 1610 further comprises a first set 1710 and a second set 1720 of channels formed at the top 1620 and at the bottom 1630 of the housing respectively.

Mounted in the first set and second set of channels 1710, 1720 are a plurality of contacts which are arranged in two distinct sets with a first set of contacts 1810 mounted in the first set of channels 1710 and a second set of contacts 1820 mounted in the second set of channels 1720. Preferably, each contact comprises a front portion 1830, a middle portion 1840 and an end portion 1850, wherein the front portion 1830 serves to connect the high density cable connector 1600 electrically to the complementary connector via the corresponding contact on the complementary connector, the middle portion 1840 serves to anchor each contact firmly to the insulative housing 1610 and the end portion 1850 is mounted to the PCB 1500 so as to connect the contact of the high density cable connector 1600 to the corresponding conductive pads formed on the PCB 1500. While the contacts 1810, 1820 are shown to be straddle-mounted to the PCB 1500 in FIGS. 3A and 3B, other forms of mounting the contacts 1810, 1820 to the PCB 1500 are also possible and are within the scope of the invention.

Preferably, within the insulative housing 1610 of the high density cable connector 1600, there is a shielding device to minimize the electrical signals of the first set of contacts 1810 from interfering with the electrical signals of the second set of contacts 1820 (a phenomena also known as cross-talking) and vice versa. The need to minimize cross-talking becomes important when handling high speed data exchange or when handling signals which have a rise time of 30 picoseconds or more. In the embodiment as illustrated in FIGS. 3A and 3B, the shielding device may be a shielding plate 1900 sandwiched between the first set of contacts 1810 and the second set of contacts 1820.

Figure 4A:
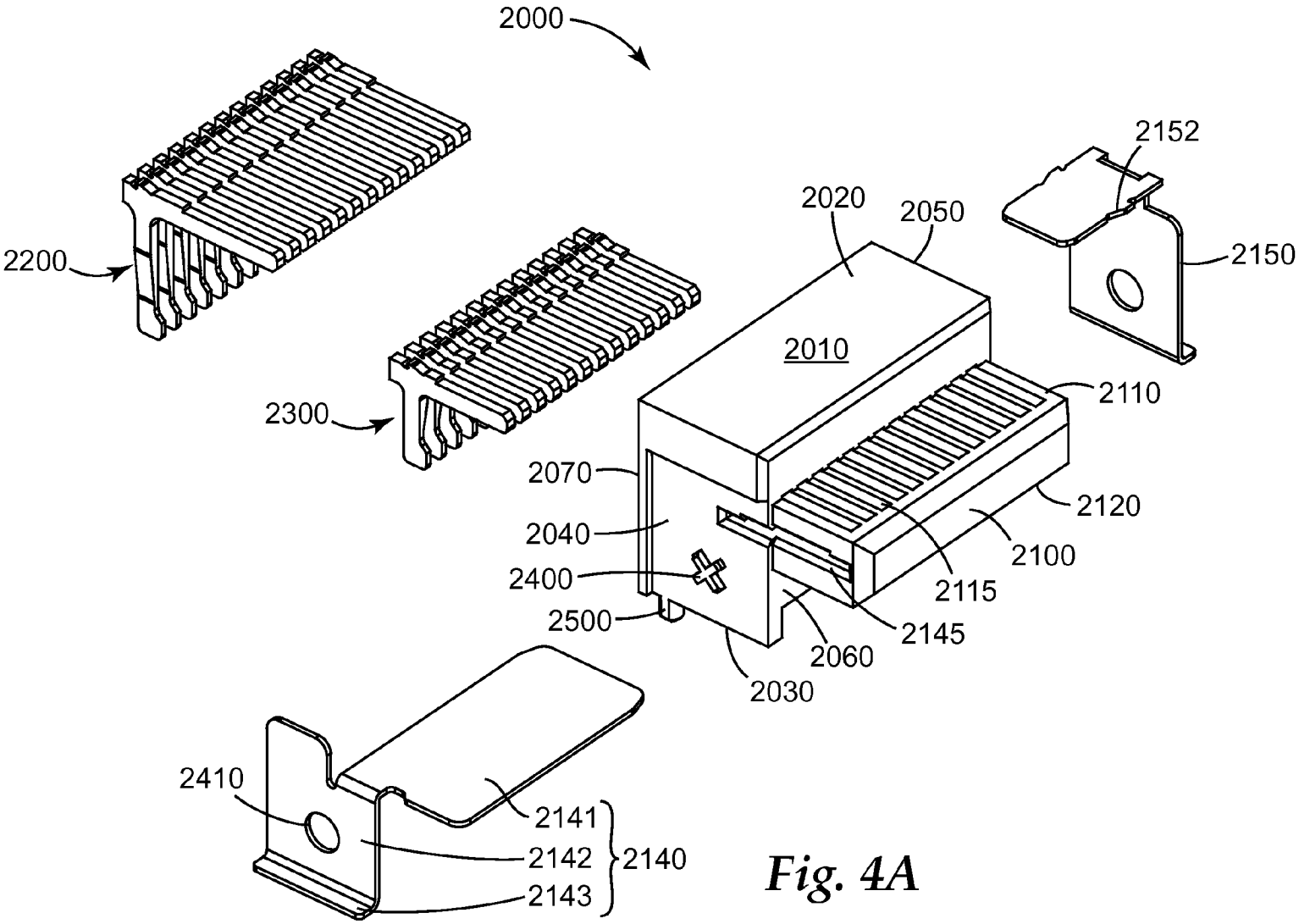
FIG. 4A shows an exploded view of an embodiment of the high density connector of FIG. 1 taken from a first body side.
Figure 4B:
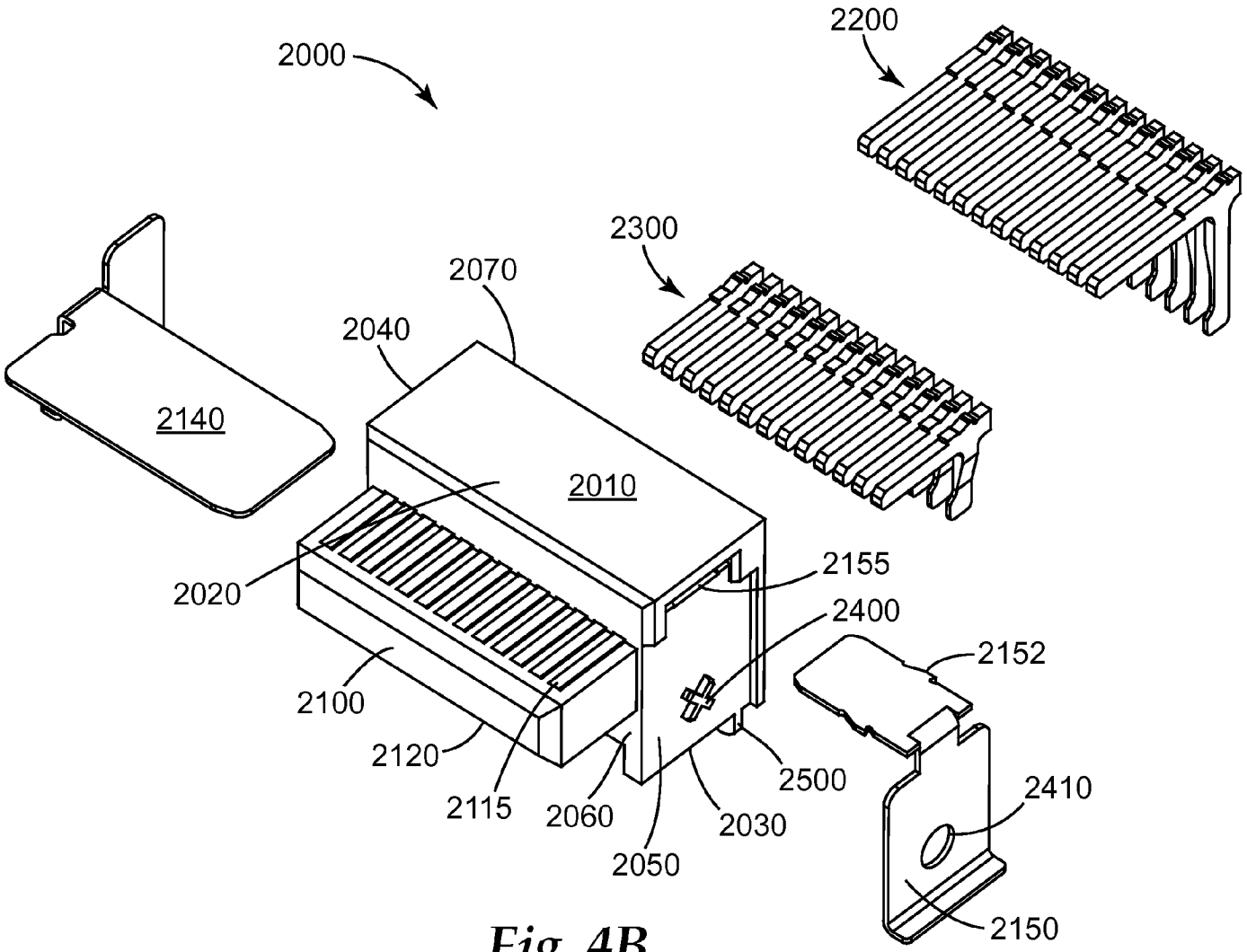
FIG. 4B shows an exploded view of the high density connector of FIG. 4A taken from a second body side.
Figure 6:
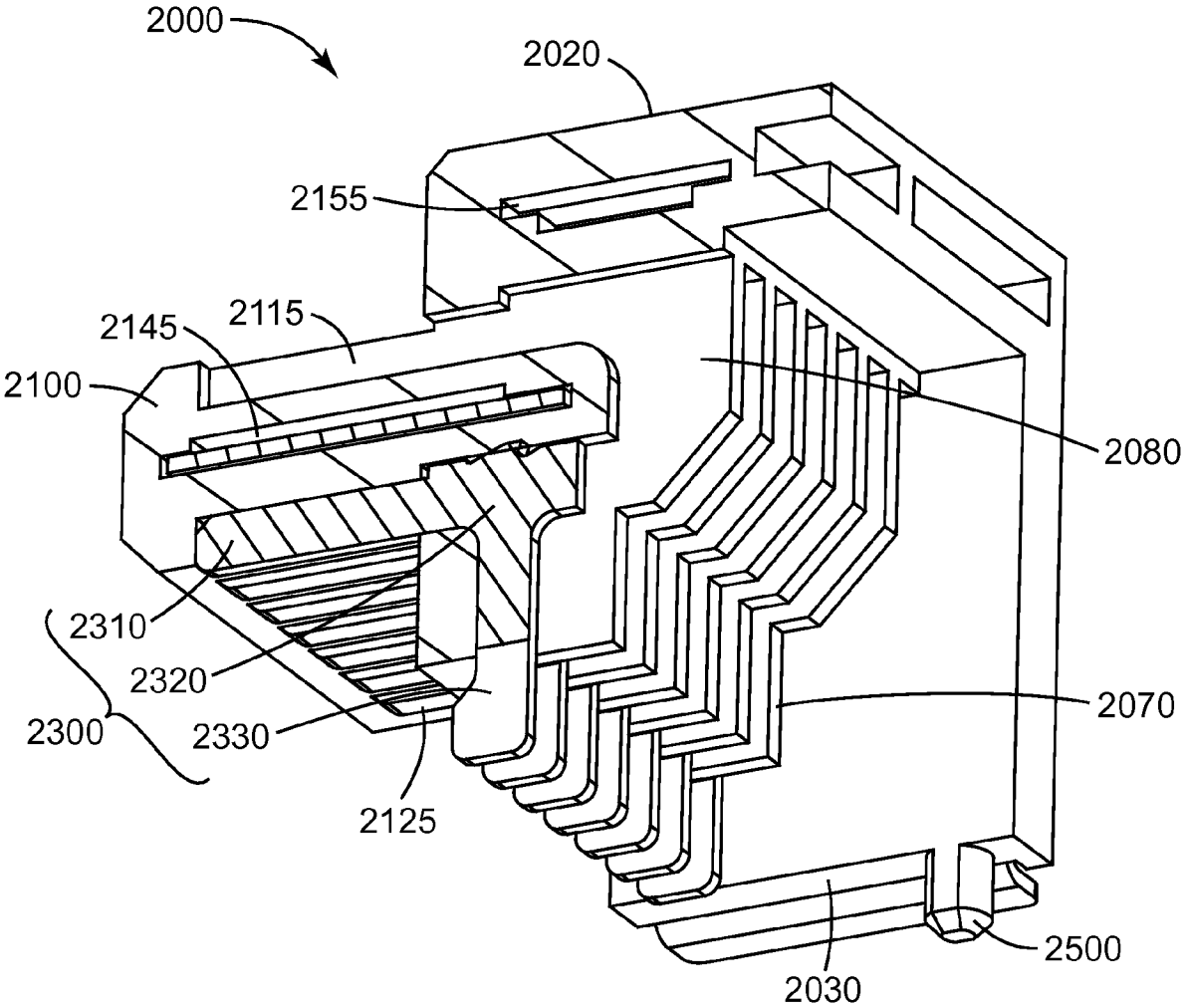
FIG. 6 shows a vertical cross-sectional view of an insulative housing of the high density connector with a terminal in place within the insulative housing.

With reference to FIGS. 4A and 4B, an embodiment of the high density connector 2000 comprises an insulative body 2010, preferably formed from a dielectric material, having a top 2020, a bottom 2030, a front face 2060 and a rear face 2070. Extending from the front face 2060 away from the insulative body 2010 is a tongue 2100 having a top tongue surface 2110 with a first set of tongue slots 2115 which extends from the tongue 2100 into the insulative body 2010 and a bottom tongue surface 2120 with a second set of tongue slots 2125 (as shown in FIG. 6) aligned to the first set of tongue slots 2115 and extending from the tongue 2100 into the insulative body 2010. Mounted in the first set of tongue slots 2115 is a first set of terminals 2200 and mounted in the second set of tongue slots 2125 is a second set of terminals 2300.

The high density connector 2000 further comprises a first body side 2040, a second body side 2050 and a plurality of lateral slots extending from either one body side or both body sides of the connector wherein each lateral slot is configured to receive an attachment device. Preferably, each attachment device comprises a lateral portion which is inserted into the corresponding lateral slot in the high density connector 2000, an attachment tail portion for bonding to the high density connector 2000 to the PCB 500 and a body portion connecting the lateral portion to the attachment tail portion.

In one embodiment as illustrated by FIG. 4A, a first attachment device 2140 comprising a lateral portion 2141, an attachment tail portion 2143 and a body portion 2142 connecting the lateral portion 2141 to the attachment tail portion 2143, is mounted to a first lateral slot 2145 which extends from the first body side 2040 into the high density connector 2000. The attachment tail portion 2143 when bonded to the PCB 500 secures the high density connector 2000 to the PCB 500. Different ways of bonding the attachment tail portion 2143 to the PCB 500 may be used, including but not limited to, soldering.

Preferably, the first lateral slot 2145 is sandwiched between the first and the second set of tongue slots 2115, 2125 and the lateral portion 2141 of the first attachment device 2140 extends from the first body side 2040 to the second body side 2050. If the first attachment device 2140 is made of metallic material, in addition to bonding the high density connector 2000 to the PCB 500, the first attachment device 2140 also acts as a grounding device and shields the first set of terminals 2200 from the second set of terminals 2300 (and vice versa) thereby reducing cross-talking between the two sets of terminals, a feature which is important especially for high speed connection.

In another embodiment, a second attachment device 2150 may be mounted to a second lateral slot 2155 (as illustrated in FIG. 4B) which extends from the second body side 2050 into the high density connector 2000, providing additional stability to the bonding of the high density connector 2000 to the PCB 500. It is worthwhile to note that the two lateral slots 2145, 2155 may either be on the same lateral plane or one lateral slot may be on an elevated plane compared to the other slot. All variations are within the scope of the invention.

Preferably, the attachment device 2140 is further secured to the high density connector 2000. In one embodiment, the high density connector 2000 further comprises a securing device 2400 which when connected to a complementary securing device 2410 on the attachment device 2140, enables the attachment device 2140 to be firmly secured to the high density connector 2000. In another embodiment, the attachment device 2150 further comprises a plurality of retention barbs 2152 which may assist in securing the attachment device 2150 to the high density connector 2000 as the retention barbs 2152 engages the sides of the second lateral slot 2155 when the attachment device 2150 is mounted in the second lateral slot 2155.

In another embodiment, the high density connector 2000 may further comprises a plurality of mounting posts 2500 extending from the bottom 2030 of the insulative body 2010 which facilitates the mounting of the high density connector 2000 to the PCB 500.

It is worthwhile to note that while a header is used to explain and illustrate the high density connector 2000, it is possible to replace the header with a socket and/or use a hybrid connector that functions both as a socket and a header, without changing the spirit of the invention.

Figure 5A:
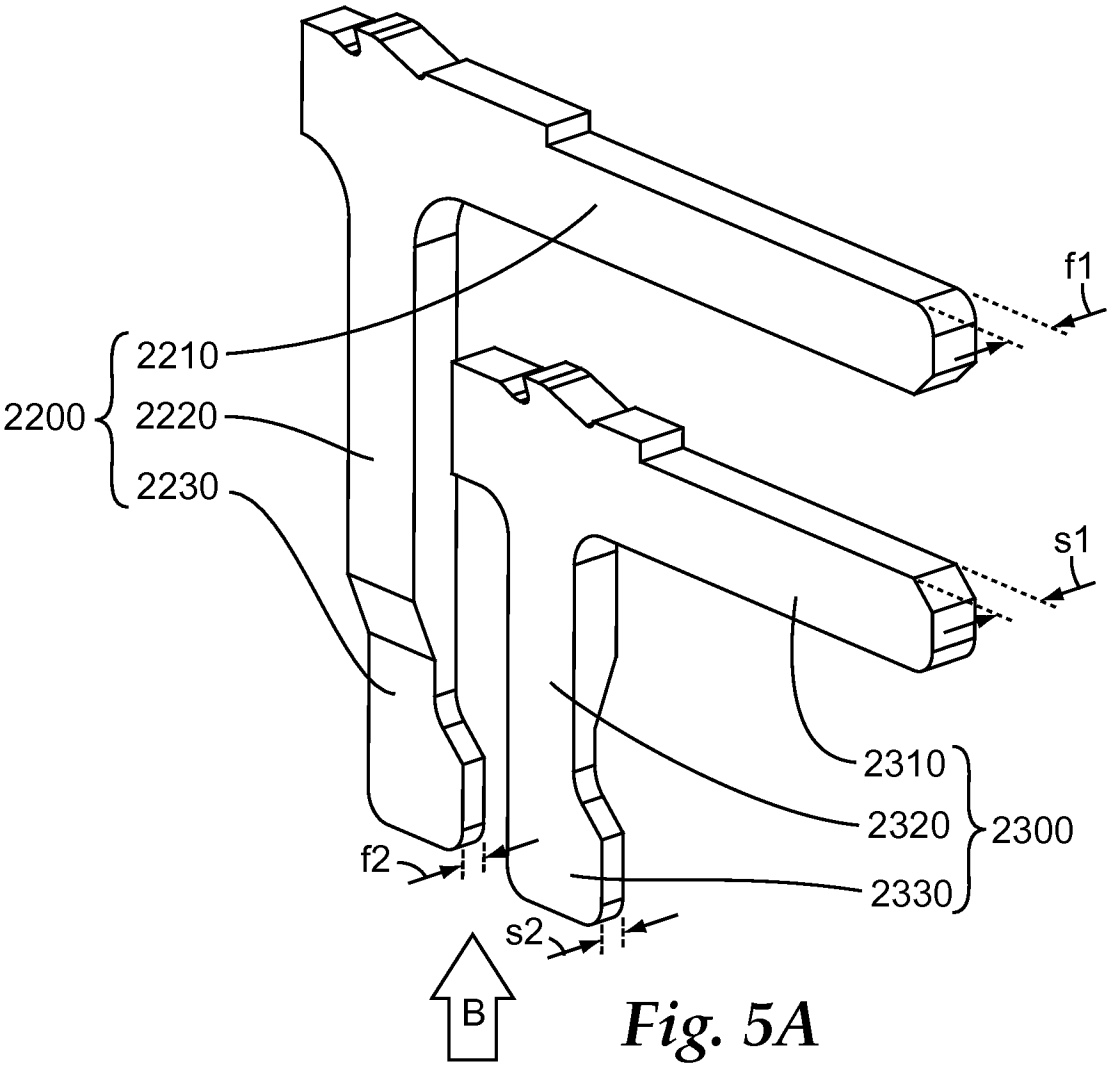
FIG. 5A shows a close-up view of a pair of terminals in the high density connector.
Figure 5B:
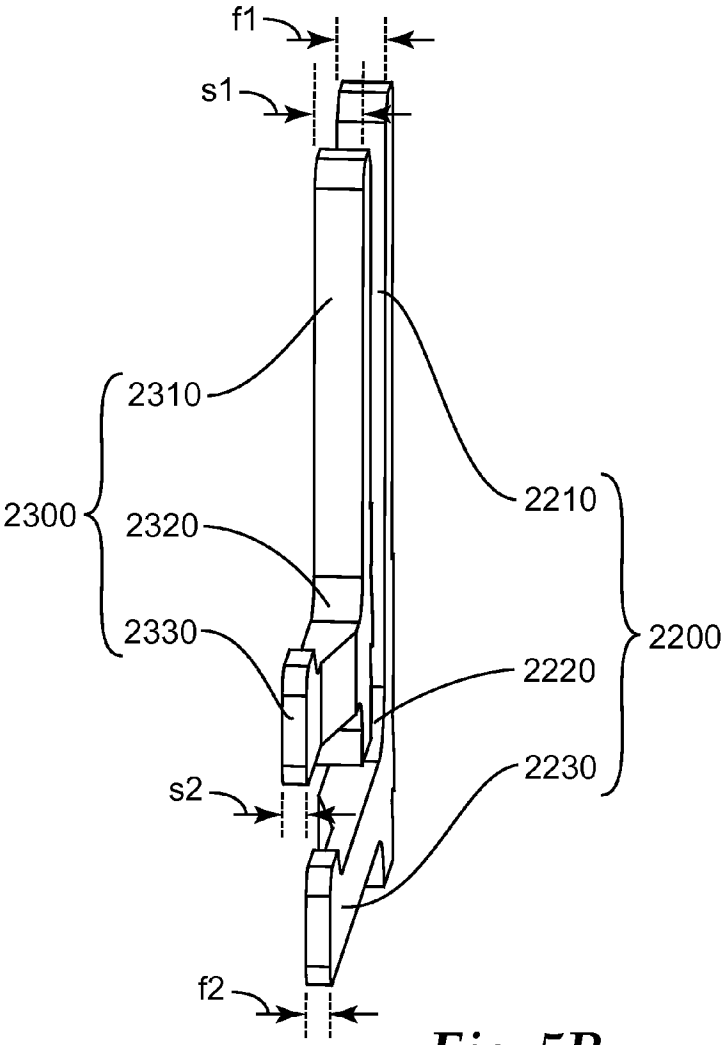
FIG. 5B shows a close-up view of the pair of terminals in FIG. 5A taken from the direction as indicated by arrow B.

FIG. 5A shows a pair of terminals taken from the first set and the second set of terminals 2200, 2300 in the high density connector 2000. FIG. 5B shows a view of the pair of terminals as in FIG. 5A taken in the direction of arrow B. Each terminal in the first set of terminals 2200 comprises a mating portion 2210, a terminal tail portion 2230 and a body portion 2220 connecting the mating portion 2210 to the terminal tail portion 2230, wherein the width f1 of the mating portion 2210 is greater than the width f2 of the terminal tail portion 2230. Similarly, each terminal in the second set of terminals 2300 comprises a mating portion 2310, a terminal tail portion 2330 and a body portion 2320 connecting the mating portion 2310 to the terminal tail portion 2330, wherein the width s1 of the mating portion 2310 is greater than the width s2 of the terminal tail portion 2330.

While the components of a terminal from the first set of terminals 2200 is similar to the components of a terminal from the second set of terminals 2300, the physical dimensions of each terminal from the first set of terminals 2200 is longer and taller than each terminal from the second set of terminals 2300. This is because every terminal in the first set of terminals 2200 is aligned to a corresponding terminal in the second set of terminals 2300. With this terminal arrangement, the physical width of the high density connector 2000 as well as the footprint which the high density connector 2000 occupies on the PCB 500 may be kept small.

FIG. 6 shows a vertical cross-sectional view of the high density connector 2000 taken from the second body side 2050. By adding a rear face extension 2080 to the rear face 2070, the first set of terminals 2200 (not shown) may be mounted in the first set of tongue channels 2115 and aligned behind the second set of terminals 2300 while maintaining a safe distance from the second set of terminals 2300.

The mating portions 2210, 2310 serve to connect the high density connector 2000 electrically to a complementary connector, which may include the high density cable connector 1600 of the high density cable assembly 1000, via the contacts in the complementary connector, while the terminal tail portions 2230, 2330 are mounted to the PCB 500 so as to connect the contacts of the high density connector 2000 to the corresponding conductive pads formed on the PCB 500. There are many ways in which the terminal tail portions 2230, 2330 may be bonded to the PCB 500 including but not limited to, soldering.

The robustness of a connector may depend on, amongst other parameters, the width of the mating portions of the terminals in the connector which determines the area of contact between two mating connectors. In very small form connectors, the width of the mating portion of a terminal in a connector is often in the range of 0.2 mm to 0.4 mm. As the width is decreased from 0.4 mm to 0.2 mm, the area of contact between two connectors decreases and therefore, the robustness of the connector decreases. Having a wide mating portion and keeping the width of the terminal tail portion to be the same as the mating portion will mean that the footprint of the connector on the PCB needs to be increased. The ability to increase the footprint of a connector may not be possible if the real estate on the PCB is limited as in a compact electronic device.

Thus, by reducing the width of the terminal tail portion, we can maintain the robustness of the connector by having a relatively wide mating portion without increasing the footprint of the connector on the PCB. In one embodiment, a small form connector has the widths f1, s1 of the mating portions 2210, 2310 set to 0.4 mm while the widths f2, s2 of the terminal tail portions 2230, 2330 set to 0.2 mm to provide good electrical contact between two connectors and maintaining the 0.8 mm pitch between terminals as required in most small form connectors. One possible way of reducing the width of the terminal tail portion is by stamping away the excess material of the terminal at the terminal tail portion.

Preferably, the material is removed from opposite ends of the terminal tail portions for terminals from the first set of terminals and the second set of terminals. Referring to FIG. 5B, the material on the right side (as viewed from the mating face) of the terminal tail portion 2230 was removed for the first set of terminals 2200 while the material on the left side (as viewed from the mating face) of the terminal tail portion 2330 was removed for the second set of terminals 2300.

Figure 7:
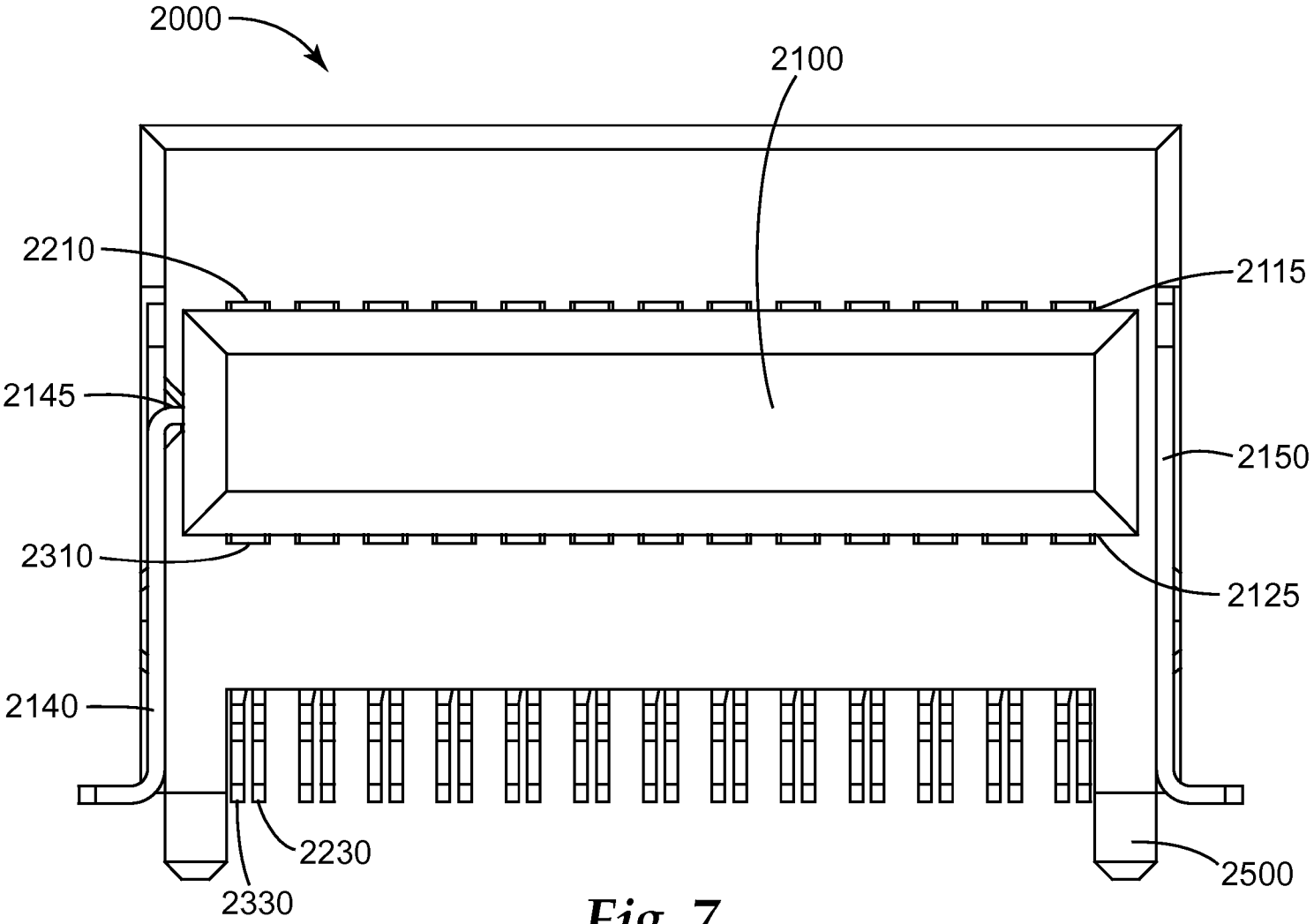
FIG. 7 shows a view of the high density connector of FIG. 1 taken from a mating face.

As illustrated in FIG. 7, by staggering the removal of the material from the terminal tail portions 2230, 2330 for terminals from the first set and the second set of terminals 2200, 2300, it will be easy to identify the terminal tail portions for each set of terminals. This facilitates the visual inspection process during the soldering of the terminals 2200, 2300 to the PCB 500 and negates the need to have an electronic testing device to quality assure the soldering of the terminals 2200, 2300 to the PCB 500.

Figure 8:
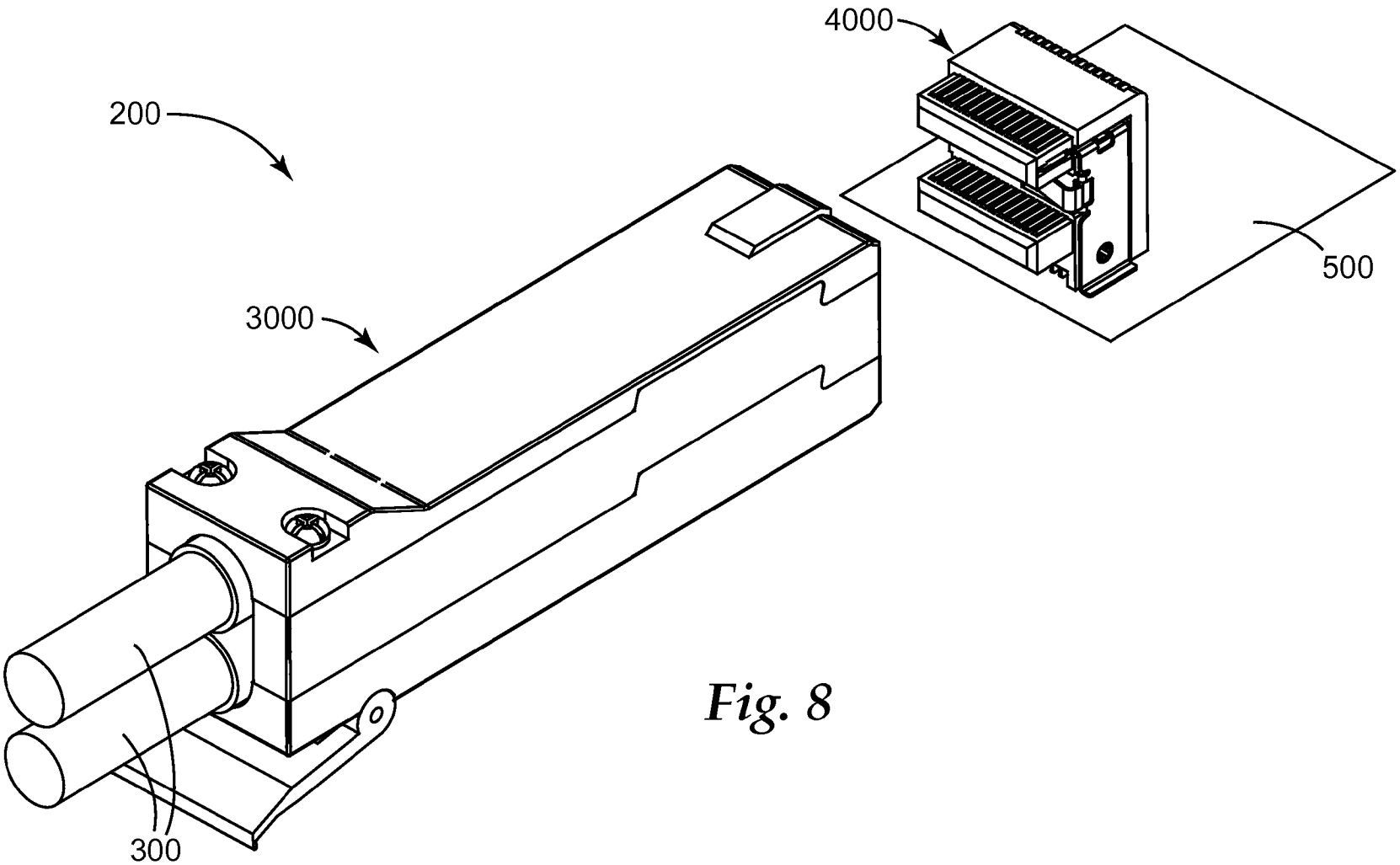
FIG. 8 shows a perspective view of another exemplary system of the present invention comprising one set of the system in FIG. 1 stacked on top of another set of the system in FIG. 1.

FIG. 8 shows another exemplary system 200 of the present invention comprising a stacked high density cable assembly 3000 and a stacked high density connector 4000 mounted on a printed circuit board 500.

Figure 9:
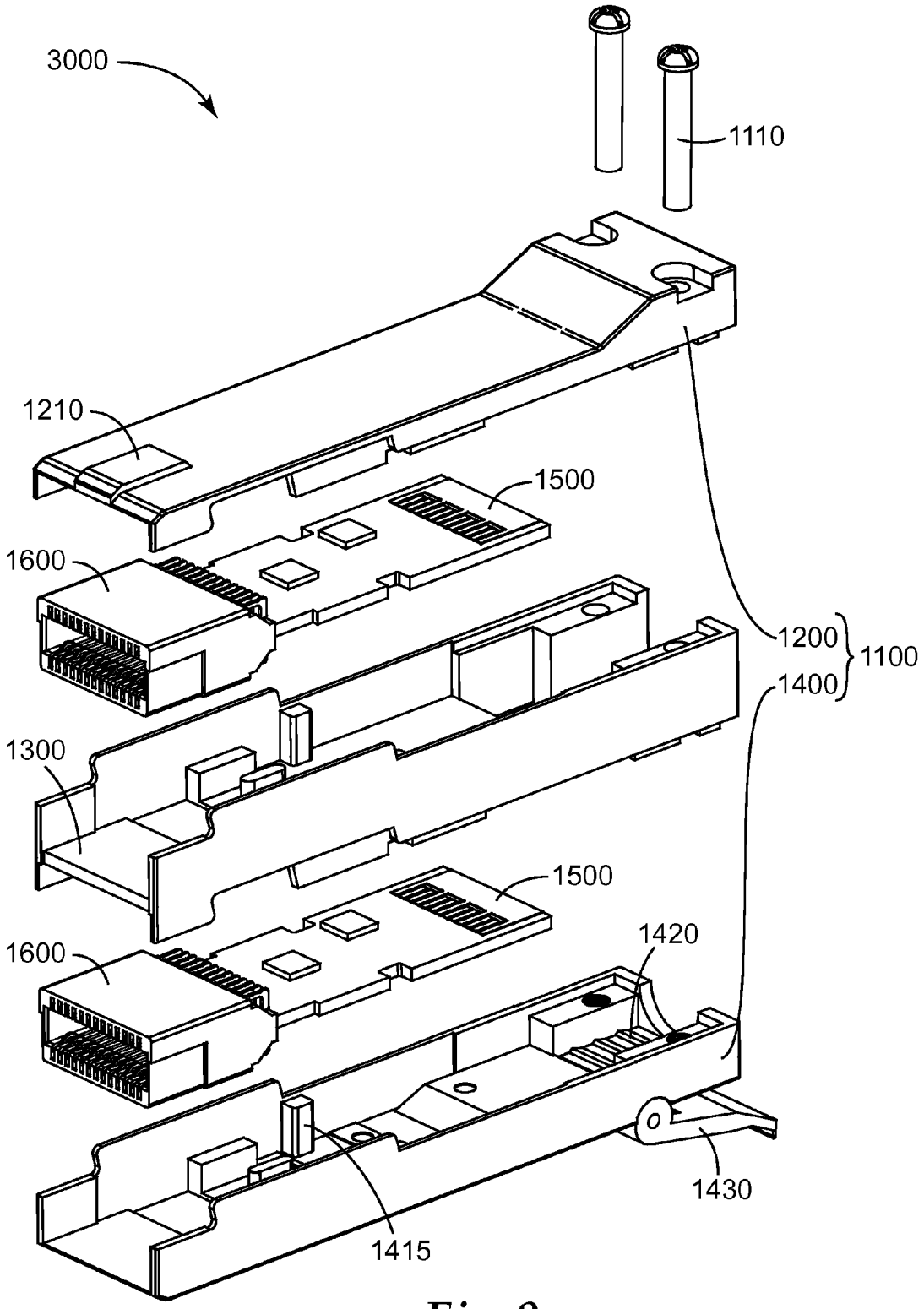
FIG. 9 shows an embodiment of a stacked high density cable assembly.

Referencing FIG. 9, the stacked high density cable assembly 3000 comprises a cable housing 1100 enclosing a plurality of PCBs 1500, a plurality of high density cable connectors 1600 and a plurality of shielded cables 300 (as shown in FIG. 8), coupled together in similar fashion to that illustrated in FIGS. 2A and 2B. Preferably, between each set of high density cable connector 1600, PCB 1500 and shielded cable 300, there is a system separator 1300 which may provide grounding and EMI shielding.

Figure 10A:
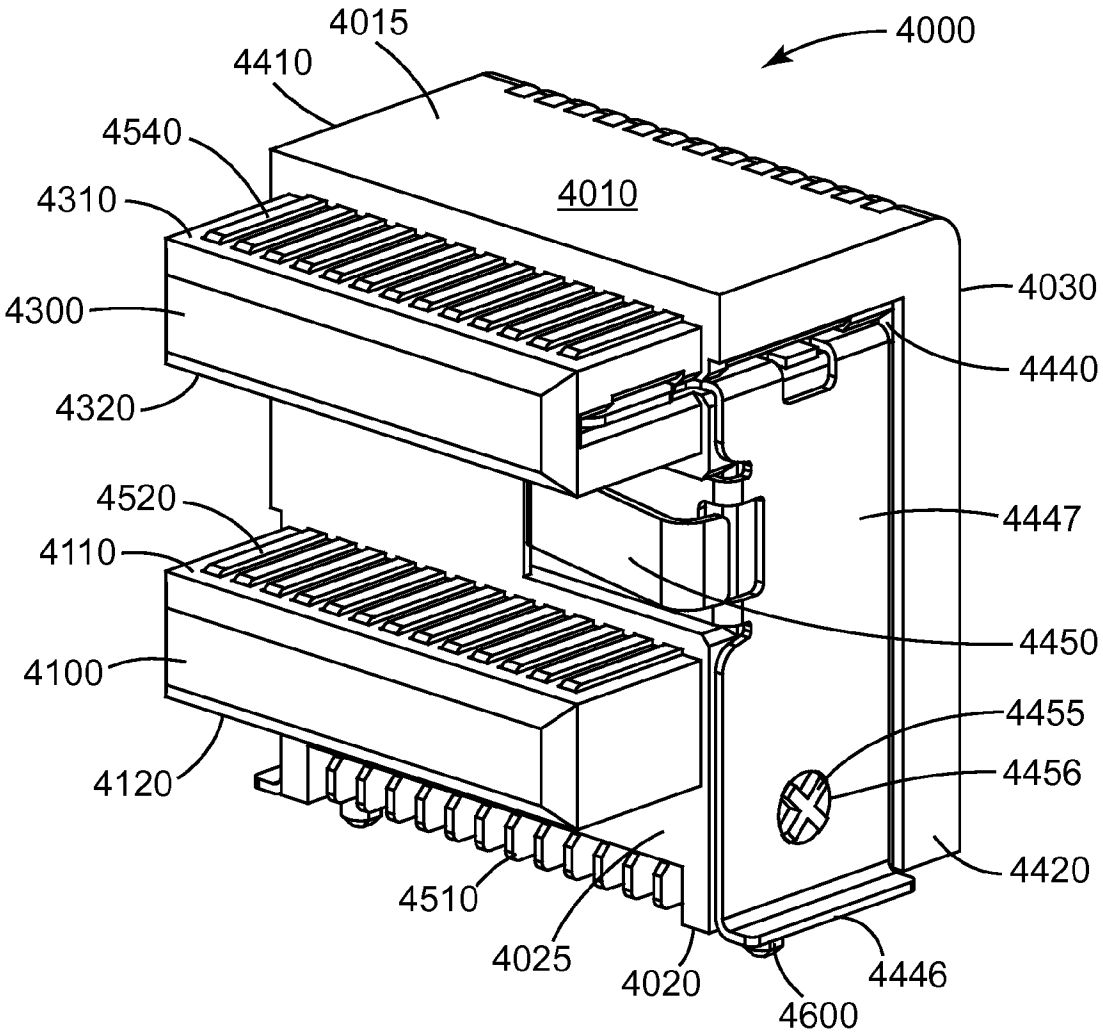
FIG. 10A shows an embodiment of a stacked high density connector.
Figure 10B:
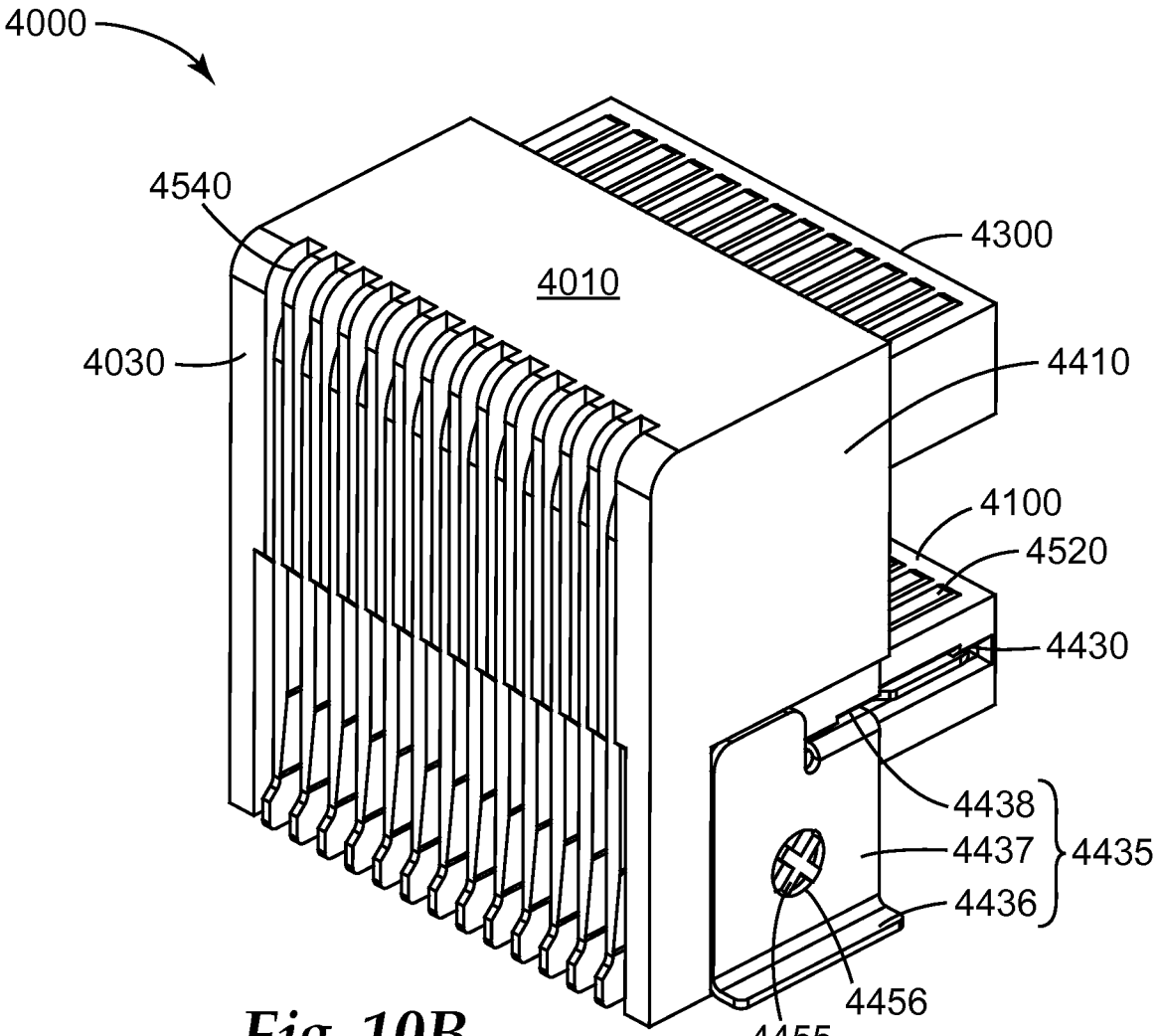
FIG. 10B shows a view of the stacked high density connector in FIG. 10A taken from the rear face.
Figure 10C:
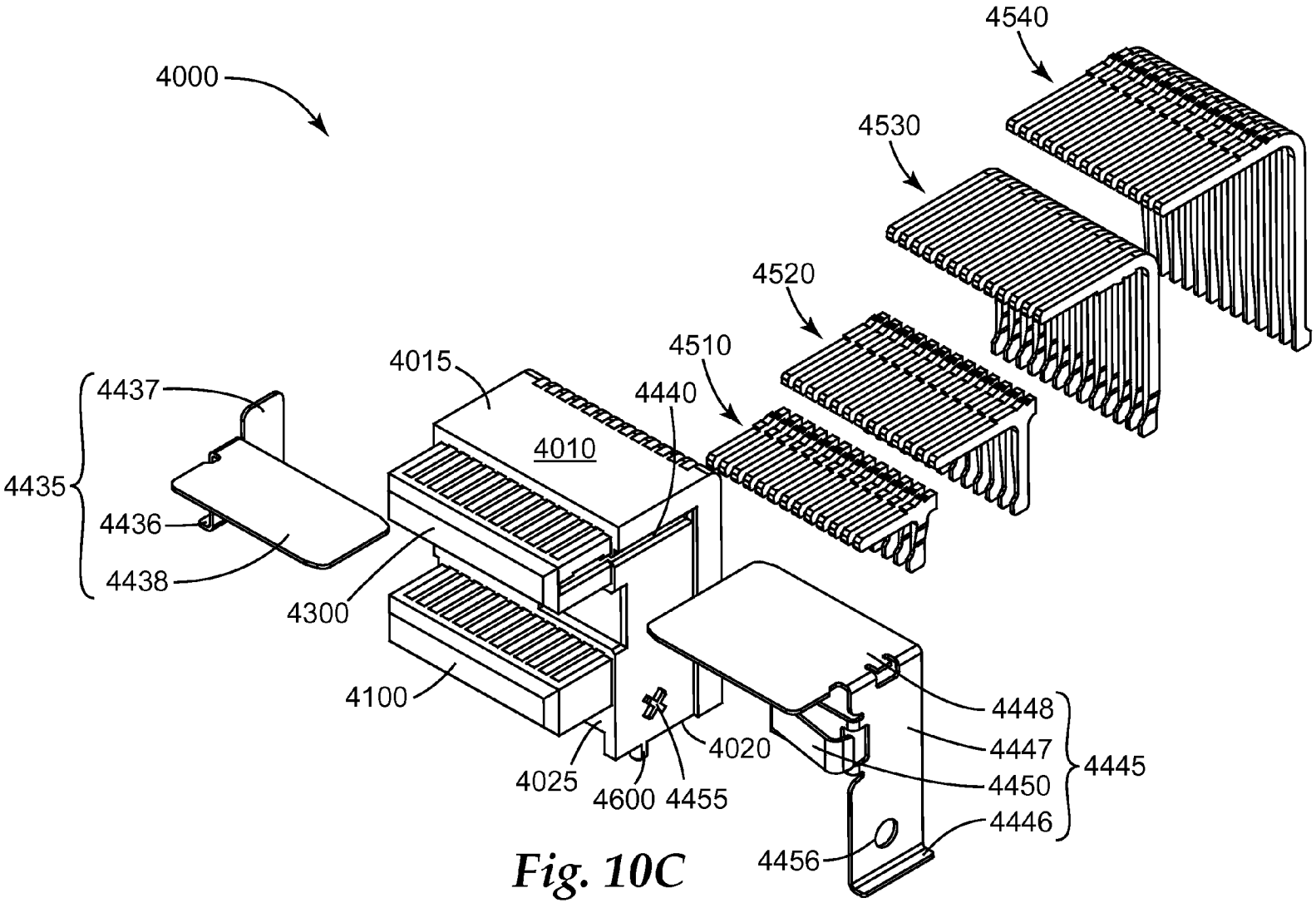
FIG. 10C shows an exploded view of the stacked high density connector in FIG. 10A.

With reference to FIGS. 10A, 10B and 10C, an embodiment of the stacked high density connector 4000 comprises a stacked insulative body 4010, preferably formed from a dielectric material, having a top 4015, a bottom 4020, a front face 4025 and a rear face 4030. Extending from the front face 4025 away from the insulative body 4010 is a plurality of tongues 4100, 4300 each having a top tongue surface 4110, 4310 and a bottom tongue surface 4120, 4320, wherein a plurality of sets of tongue slots (similar to the tongue slots 2115, 2125 as described in the earlier embodiment) are incorporated on each tongue surface and each set of tongue slots extends from the tongues 4100, 4300 into the insulative body 4010.

Mounted in each set of tongue slots are sets of terminals 4510, 4520, 4530 and 4540, with each terminal having similar features to the terminals 2200, 2300 described earlier. For the same reasons as discussed earlier, each set of terminals is aligned to one another. In order that the conductive pads on the PCB whereby the terminal tail portions are soldered to the PCB may be arranged in a staggered layout, the terminal tail portions for the set of terminals 4520, 4540 which are mounted on the top tongue surfaces 4110, 4310 are reduced in width by stamping on the same side (e.g. right) while the terminal tail portions for the set of terminals 4510, 4530 which are mounted on the bottom tongue surface 4120, 4320 are reduced in width by stamping on the other side (e.g. left).

The stacked high density connector 4000 further comprises a first body side 4410, a second body side 4420 and a plurality of lateral slots 4430, 4440 extending from either one body side or both body sides of the connector wherein each lateral slot 4430, 4440 is configured to receive an attachment device 4435, 4445 mounted to the lateral slot 4430, 4440. Preferably, each attachment device 4435, 4445 comprises a lateral portion 4438, 4448 which is inserted into the corresponding lateral slot 4430, 4440 in the stacked high density connector 4000, an attachment tail portion 4436, 4446 for bonding to the stacked high density connector 4000 to the PCB 500 and a body portion 4437, 4447 connecting the lateral portion 4438, 4448 to the attachment tail portion 4436, 4446.

Preferably, for the same reason of reducing cross-talk between terminals as described earlier, the lateral slots are incorporated between the set of terminals slots on the top tongue surface and the set of terminal slots on the bottom tongue surface. Preferably, the attachment device is made of metallic material. Preferably, at least one of the attachment device 4445 further comprises a grounding arm 4450 which may provide additional grounding capability for the whole system when the grounding arm 4450 comes into contact with the system separator 1300 when the stacked high density cable assembly 3000 is coupled to the stacked high density connector 4000.

In one embodiment, the stacked high density connector 4000 further comprises a securing device 4455 which when connected to a complementary securing device 4456 on the attachment device 4445, enables the attachment device 4445 to be firmly secured to the stacked high density connector 4000. In another embodiment, the stacked high density connector 4000 may further comprises a plurality of mounting posts 4600 extending from the bottom 4020 of the stacked insulative body 4010 which facilities the mounting of the stacked high density connector 4000 to the PCB 500.

Figure 11:
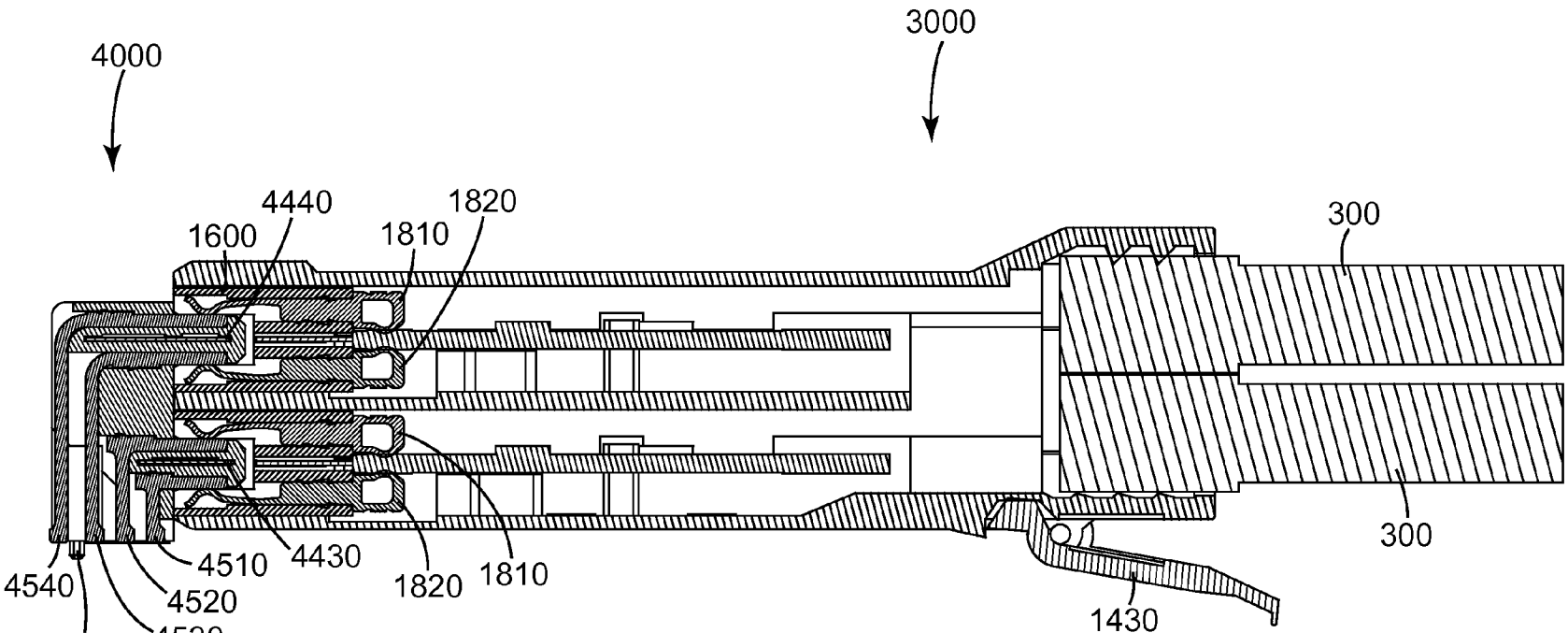
FIG. 11 shows a vertical cross-sectional view of the system in FIG. 8 with the stacked high density cable assembly coupled to the stacked high density connector.

FIG. 11 shows a vertical cross-sectional view of the stacked high density connector 4000 when mated with the respective high density cable connector 1600 of the stacked high density cable assembly 3000.

FIGS. 12A-15 show an exemplary embodiment of a latch mechanism that can be used in a high density cable assembly according to an aspect of the present invention. High density cable assembly 5000 (shown in FIG. 14) is similar to high density cable assembly 1000 described in detail above and includes a cable housing 5100. Cable housing 5100 includes a top cover 5200 and a bottom cover 5400. Top cover 5200 holds a latch mechanism 5230 which may be used to couple/de-couple the high density cable assembly 5000 to/from a metal cage 600 (shown in FIGS. 14 and 15) housing the high density connector 2000 on a PCB 500 of an electronic device.

Figure 12C:
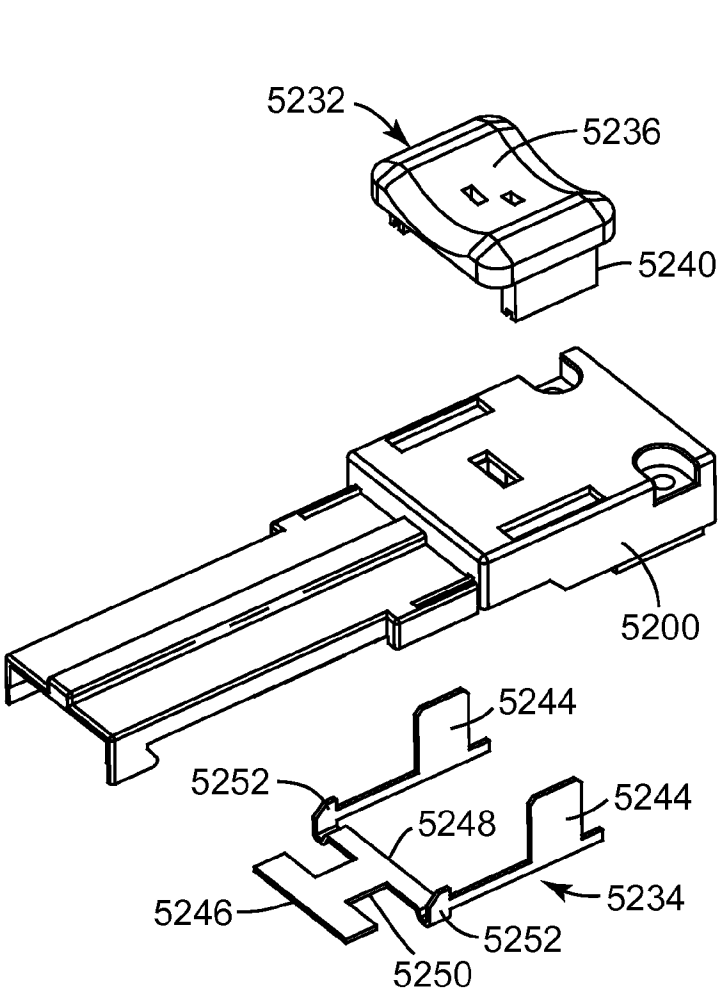
FIG. 12C shows a top perspective exploded view of the latch mechanism of FIG. 12A.
Figure 12A:
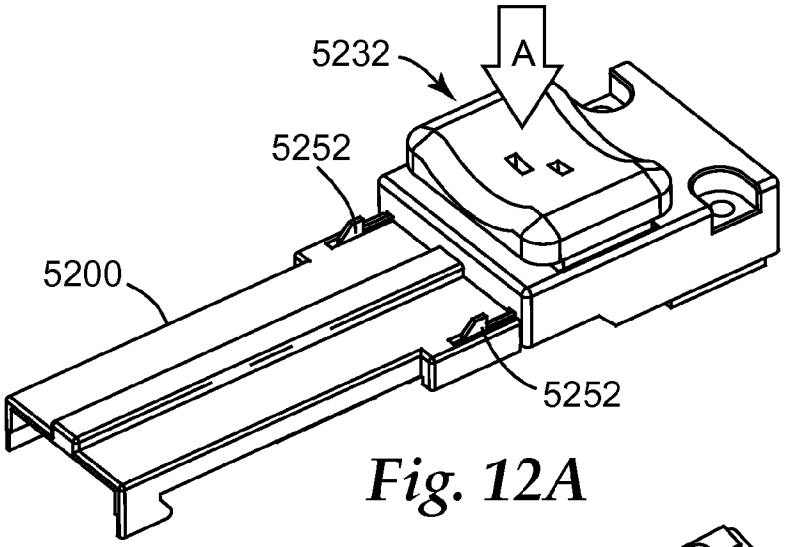
FIG. 12A shows a top perspective view of an exemplary embodiment of a latch mechanism that can be used in a high density cable assembly according to an aspect of the present invention.
Figure 12B:
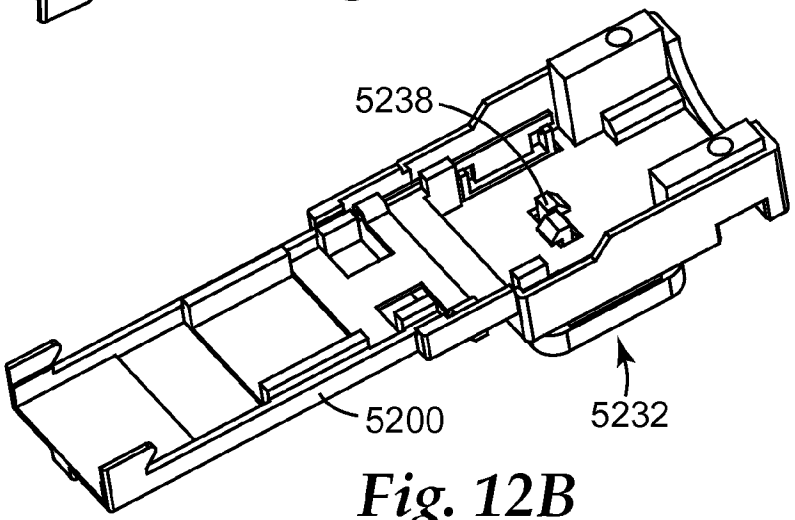
FIG. 12B shows a bottom perspective view of the latch mechanism of FIG. 12A.
Figure 13:
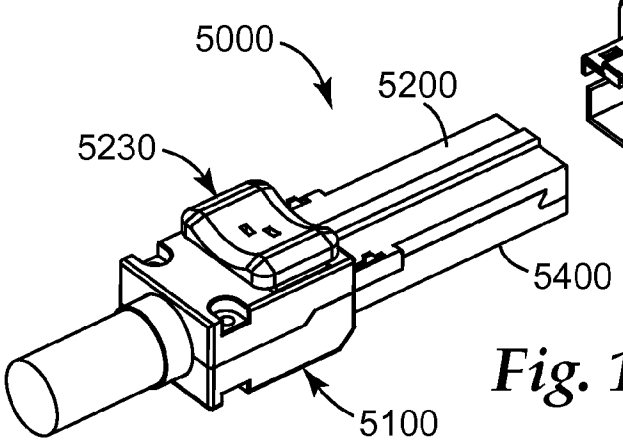
FIG. 13 shows a bottom perspective view of the latch button of the latch mechanism of FIG. 12A.
Figure 13:
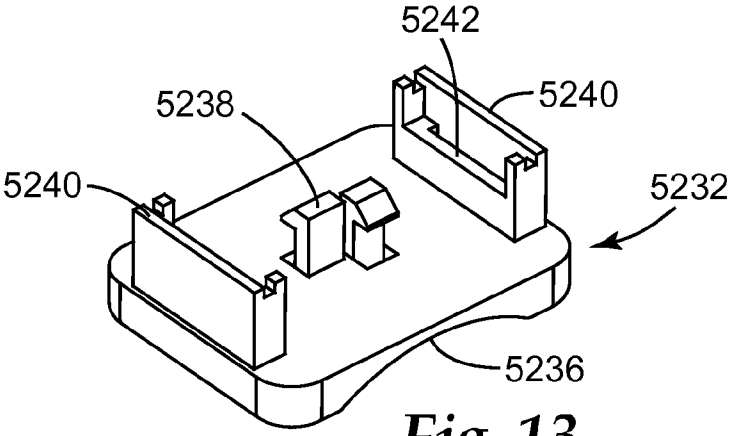
Figure 16C:
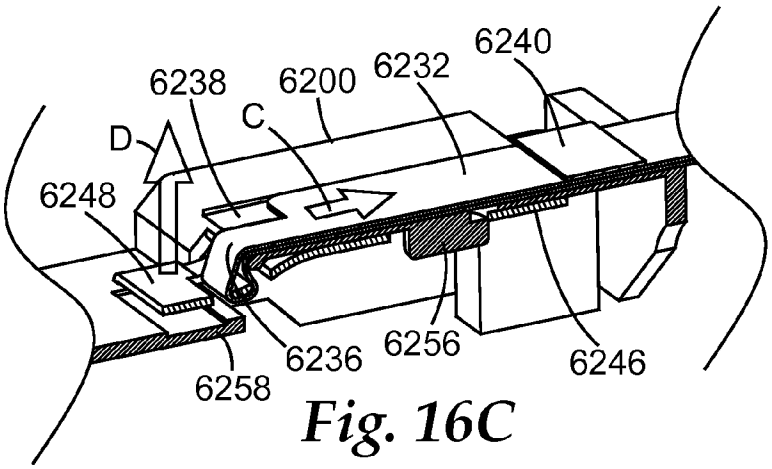
FIG. 16C shows a top perspective cross-sectional view of the latch mechanism of FIG. 16A.
Figure 17A:
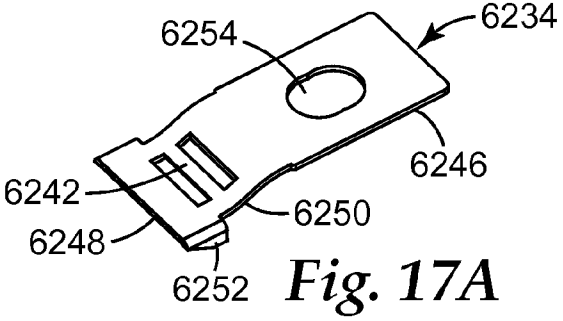
FIG. 17A shows a top perspective view of the latch arm of the latch mechanism of FIG. 16A.
Figure 17B:
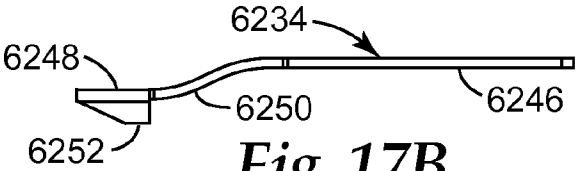
FIG. 17B shows a side view of the latch arm of FIG. 17A.
Figure 16A:
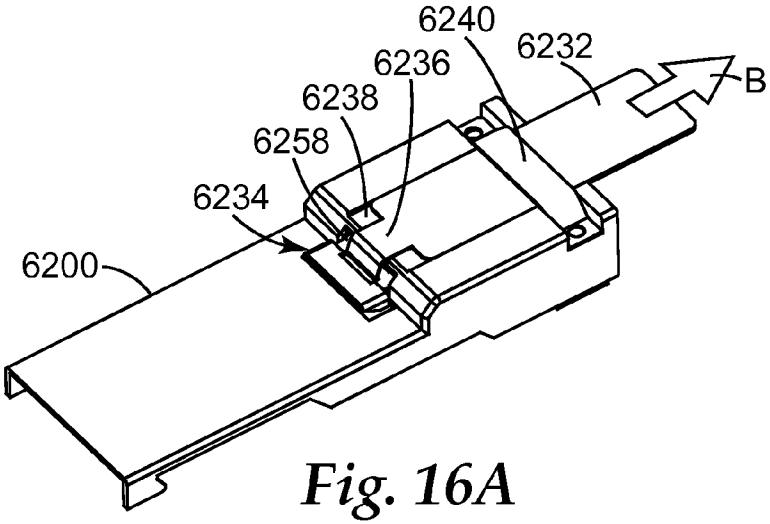
FIG. 16A shows a top perspective view of another exemplary embodiment of a latch mechanism that can be used in a high density cable assembly according to an aspect of the present invention.
Figure 16B:
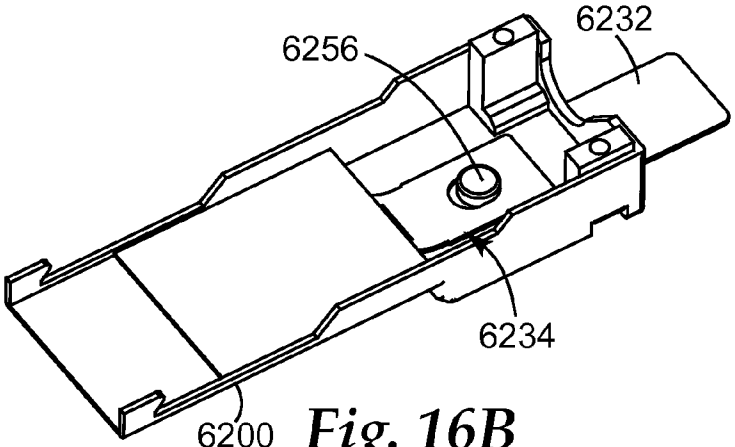
FIG. 16B shows a bottom perspective view of the latch mechanism of FIG. 16A.

As best illustrated in FIGS. 12A-13, latch mechanism 5230 includes a push button 5232 and a latch frame 5234. Push button 5232 may be formed of any suitable material, such as, e.g., a polymeric material or a metal, and by any suitable method, such as, e.g., injection molding or stamping. Push button 5232 may include a curvilinear top surface 5236 to accommodate operation by a human finger. Push button 5232 is movably connected to top cover 5200 by retention posts 5238. Retention posts 5238 are integrally formed with push button 5232 and are designed to retain push button 5232 in top cover 5200 such that push button 5232 can move a limited amount relative to top cover 5200 such that high density cable assembly 5000 can be properly coupled/de-coupled to/from metal cage 600. Push button 5232 further includes integrally formed guide posts 5240 configured to properly position and guide push button 5232 relative to top cover 5200. Each guide post 5240 includes a slot 5242 (as best shown in FIG. 13) configured to retain a corresponding retention tab 5244 of latch frame 5234. Retention tabs 5244 may be retained in slots 5242 by any suitable method/structure, including but not limited to snap fit, friction fit, press fit, and adhesive.

Figure 15:
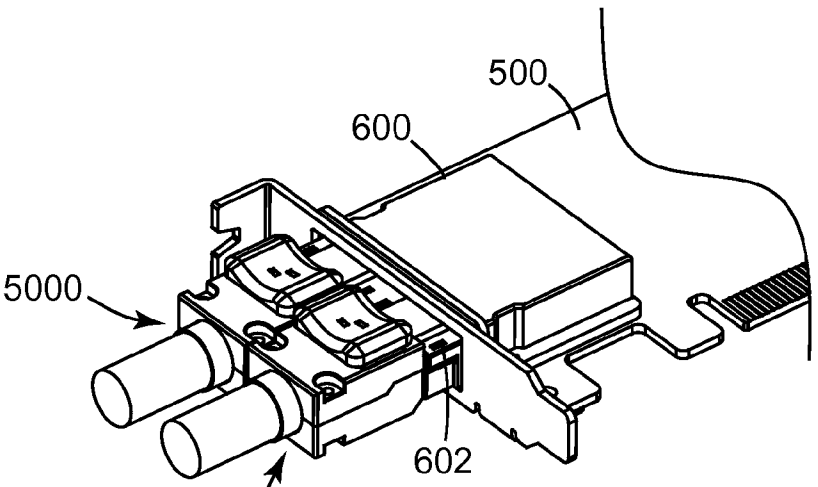
FIG. 15 shows a top perspective view of two high density cable assemblies of FIG. 14 in a mated configuration.
Figure 14:
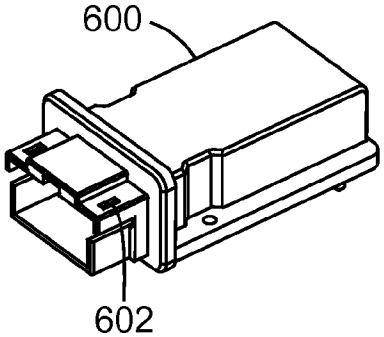
FIG. 14 shows a top perspective view of an exemplary embodiment of a high density cable assembly according to an aspect of the present invention in an unmated configuration.

Latch frame 5234 may be formed of any suitable material, such as, e.g., a polymeric material or a metal, and by any suitable method, such as, e.g., injection molding or stamping. Latch frame 5234 includes a stationary portion 5246, a movable portion 5248, and a bridge portion 5250 resiliently connecting stationary portion 5246 to movable portion 5248. Stationary portion 5246 is retained in top cover 5200 and serves as the pivot point of latch mechanism 5230. Stationary portion 5246 is retained in top cover 5200 by any suitable method/structure, including but not limited to snap fit, friction fit, press fit, mechanical clamping, and adhesive. Movable portion 5248 includes retention tabs 5244 and latches 5252 formed integrally with and extending from latch frame 5234. As best shown in FIGS. 14 and 15, during insertion of high density cable assembly 5000 into metal cage 600, latches 5252 are resiliently pushed downward by metal cage 600 after which they snap into openings 602 of metal cage 600, thereby latching (coupling) high density cable assembly 5000 to metal cage 600. To extract high density cable assembly 5000 from metal cage 600, push button 5232 is pushed (as indicated by arrow A in FIG. 12A), whereby movable portion 5248 of latch frame 5234 resiliently pivots downward around stationary portion 5246. Therewith, latches 5252 move downward and unlatch (de-couple) high density cable assembly 5000 from metal cage 600.

FIGS. 16A-19 show another exemplary embodiment of a latch mechanism that can be used in a high density cable assembly according to an aspect of the present invention. High density cable assembly 6000 (shown in FIG. 18) is similar to high density cable assembly 1000 described in detail above and includes a cable housing 6100. Cable housing 6100 includes a top cover 6200 and a bottom cover 6400. Top cover 6200 holds a latch mechanism 6230 which may be used to couple/de-couple the high density cable assembly 6000 to/from a metal cage 700 (shown in FIGS. 18 and 19) housing the high density connector 2000 on a PCB 500 of an electronic device.

As best illustrated in FIGS. 16A-17B, latch mechanism 6230 includes a pull tab 6232 and a latch frame 6234. Pull tab 6232 is typically an integrally formed piece of insulating material, such as, e.g., a polymeric or paper material. Pull tab 6232 is designed such that it can be easily clamped between and pulled by a human finger and thumb. Pull tab 6232 is slidably positioned in a groove 6238 of top cover 6200. A pull tab bracket 6240 is connected to top cover 6200 and shaped to allow sliding movement of pull tab 6232 while keeping pull tab 6232 positioned in groove 6238. Pull tab bracket 6240 is connected to top cover 6200 by any suitable method/structure, including but not limited to snap fit, friction fit, press fit, mechanical clamping, and adhesive. Alternatively, pull tab bracket 6240 may be integrally formed with top cover 6200. Pull tab 6232 includes a connection portion 6236 configured to connect pull tab 6232 to latch frame 6234. Connection portion 6236 is sized to be looped around a connection bar 6242 of latch frame 6234 (as best shown in FIG. 16C) during assembly of latch mechanism 6230, after which it may be connected to pull tab 6232 by any suitable method/structure, including but not limited to mechanical clamping and adhesive.

Figure 19:
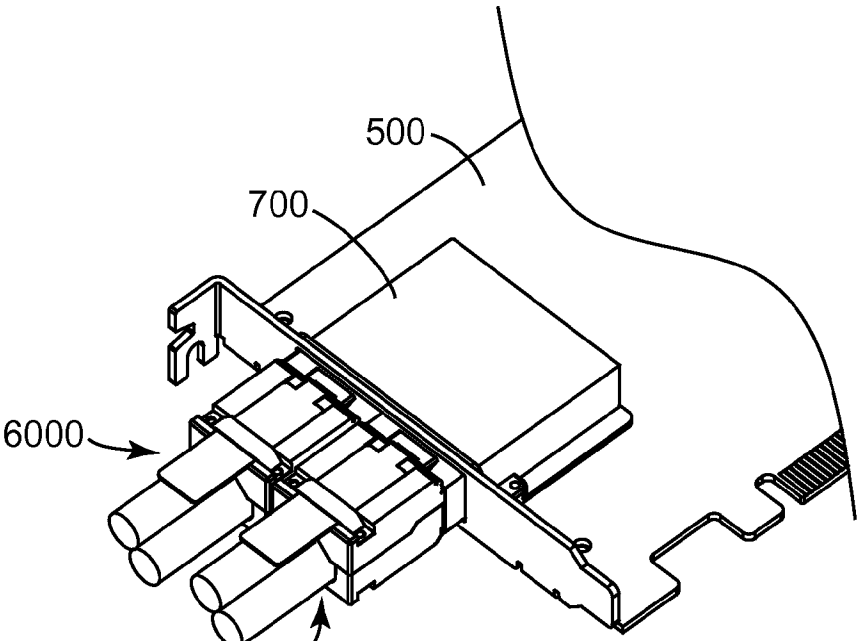
FIG. 19 shows a top perspective view of two high density cable assemblies of FIG. 18 in a mated configuration.
Figure 18:
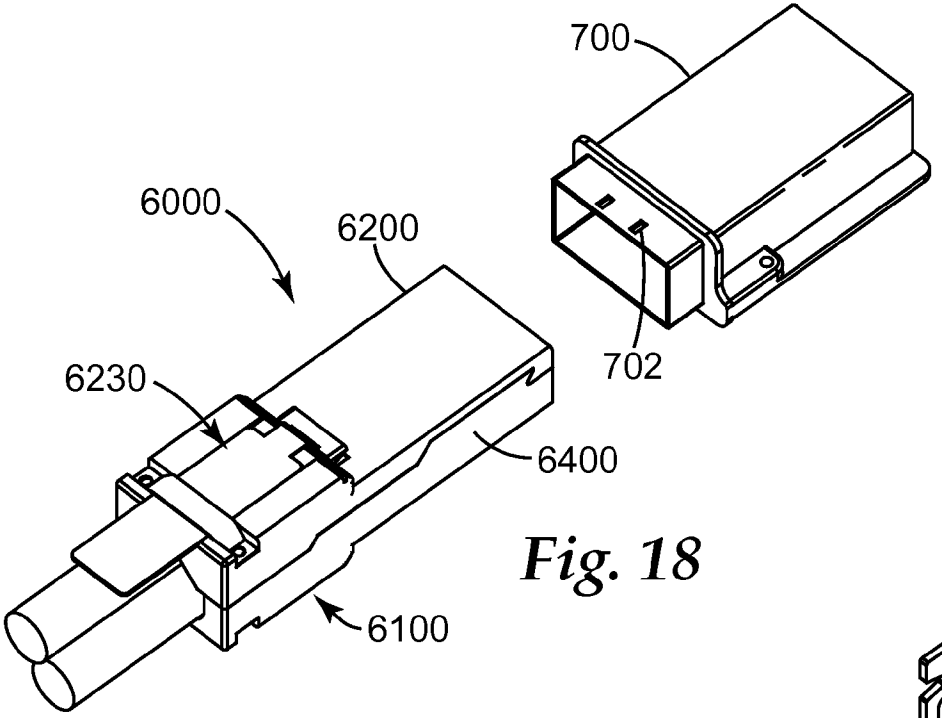
FIG. 18 shows a top perspective view of an exemplary embodiment of a high density cable assembly according to an aspect of the present invention in an unmated configuration.

Latch frame 6234 may be formed of any suitable material, such as, e.g., a polymeric material or a metal, and by any suitable method, such as, e.g., injection molding or stamping. Latch frame 6234 includes a stationary portion 6246, a movable portion 6248, and a bridge portion 6250 resiliently connecting stationary portion 6246 to movable portion 6248. Stationary portion 6246 is retained in top cover 6200 and serves as the pivot point of latch mechanism 6230. Stationary portion 6246 includes an assembly opening 6254 shaped such that latch frame 6234 can be placed over and locked into a corresponding grooved assembly post 6256 extending from top cover 6200 during assembly of latch mechanism 6230. Alternatively, stationary portion 6246 of latch frame 6234 may be retained in top cover 6200 by any suitable method/structure, including but not limited to snap fit, friction fit, press fit, mechanical clamping, and adhesive. Movable portion 6248 includes latches 6252 formed integrally with and extending from latch frame 6234. As best shown in FIGS. 18 and 19, during insertion of high density cable assembly 6000 into metal cage 700, latches 6252 are resiliently pushed upward by metal cage 700 after which they snap into openings 702 of metal cage 700, thereby latching (coupling) high density cable assembly 6000 to metal cage 700. To extract high density cable assembly 6000 from metal cage 700, pull tab 6232 is pulled (as indicated by arrows B and C in FIGS. 16A and 16C respectively), whereby movable portion 6248 of latch frame 6234 resiliently pivots upward around stationary portion 6246 (as indicated by arrow D in FIG. 16C). Therewith, latches 6252 move upward and unlatch (de-couple) high density cable assembly 6000 from metal cage 700. This movement is limited by a latch arm opening 6258 in top cover 6200. Alternatively, this movement may be limited in other suitable ways, such as, e.g., by a travel stop (not shown) extending from top cover 6200 into an oblong slot (not shown) in pull tab 6232.

The foregoing description of the preferred embodiment of the invention has been presented for purposes of illustration and description. It is not intended to be exhaustive or to limit the invention to the precise forms disclosed, since many modifications or variations thereof are possible in light of the above teaching. All such modifications and variations are within the scope of the invention. The embodiments described herein were chosen and described in order to best explain the principles of the invention and its practical application, thereby to enable others skilled in the art to utilize the invention in various embodiments and with various modifications as are suited to the particular use contemplated thereof. It is intended that the scope of the invention be defined by the claims appended hereto, when interpreted in accordance with the full breadth to which they are legally and equitably suited.

The invention claimed is:

1. An electrical connector comprising an insulative body having a top, a bottom, a front face and a rear face;

a plurality of tongues, each tongue haivng a top tongue surface and a bottom tongue surface, extending from the front face in a direction away from the insulative body;

one set of terminals mounted in one set of tongue slots incorporated at the top tongue surface of each tongue and another set of terminals mounted in another set of tongue slots incorporated at the bottom tongue surface of each tongue, wherein the tongue slots incorporated at the bottom tongue surface are aligned to the tongue slots incorporated at the top tongue surface; and a plurality of lateral slots in the insulative body configured to receive at least one attachment device, wherein each lateral slot is configured to receive a lateral portion of an attachment device, the lateral portion shielding the set of terminals mounted at the top tongue surface of a tongue from the set of terminals mounted at the bottom tongue surface of the tongue.

2. The electrical connector as claimed in claim 1 wherein the attachment device comprises a lateral portion which is inserted into the lateral slot, an attachment tail portion for bonding the electrical connector to a printed circuit board and a body portion connecting the lateral portion to the attachment tail portion.

3. The electrical connector as claimed in claim 1 wherein at least one lateral slot is between the two sets of tongue slots.

4. The electrical connector as claimed in claim 1 wherein the attachment device is made of metallic material.

5. The electrical connector as claimed in claim 1 wherein the attachment device is secured to the electrical connector by a securing device.

6. The electrical connector as claimed in claim 1 wherein the electrical connector further comprises a plurality of mounting posts extending from the bottom of the insulative body.

7. The electrical connector as claimed in claim 1 wherein each terminal further comprises a mating portion having a width f1 or s1, a terminal tail portion having a width f2 or s2, wherein one or both of (a) f1 is greater than f2 and (b) s1 is greater than s2, and a body portion connecting the mating portion to the terminal tail portion.

8. The electrical connector as claimed in claim 1 further comprising a rear face extension extending from the rear face so that the set of terminals at the top tongue surface may be mounted and aligned behind the set of terminals which are mounted at the bottom tongue surface.

9. An interconnect system comprising the electrical connector as claimed in claim 1.

10. An interconnect system comprising a cable assembly and the electrical connector as claimed in claim 1.

11. An electrical connector comprising an insulative body having a top, a bottom, a front face and a rear face;

a first tongue having a first top tongue surface and a first bottom tongue surface, extending from the front face in a direction away from the insulative body;

a second tongue having a second top tongue surface and a second bottom tongue surface, extending from the front face in a direction away from the insulative body;

a plurality of rear face extensions extending from the rear face in a direction away from the insulative body;

a first set of terminals mounted in a first set of tongue slots incorporated at the first bottom tongue surface, a second set of terminals mounted in a second set of tongue slots incorporated at the first top tongue surface, wherein the second set of tongue slots are aligned to the first set of tongue slots;

a third set of terminals mounted in a third set of tongue slots incorporated at the second bottom tongue surface, a fourth set of terminals mounted in a fourth set of tongue slots incorporated at the second top tongue surface, wherein the fourth set of tongue slots are aligned to the third set of tongue slots;

whereby each terminal in the first, second, third and fourth set of terminals further comprises a mating portion, a terminal tail portion and a body portion connecting the mating portion to the terminal tail portion, and the width of the mating portion is greater than the width of the terminal tail portion; and a plurality of lateral slots in the insulative body configured to receive at least one attachment device.

12. An interconnect system comprising a cable assembly and the electrical connector as claimed in claim 11.

13. A latching mechanism comprising:

a push button movably connected to a cable housing of a cable assembly; and a latch frame connected to the push button and disposed inside the cable housing and including at least one latch projecting outwardly from an opening defined by the housing and configured to couple the cable assembly to a metal cage housing a mating connector, such that pushing the push button downwardly in a linear direction perpendicular to the housing moves the at least one latch into the housing.

14. The latch mechanism as claimed in claim 13, wherein the push button includes at least one retention post designed to retain the push button in the cable housing and provide limited movement of the push button relative to the cable housing.

15. The latch mechanism as claimed in claim 13, wherein the push button includes at least one guide post configured to properly position and guide the push button relative to the cable housing and retain the latch frame.

16. The latching mechanism as claimed in claim 13, wherein the latch frame includes a stationary portion, a movable portion, and a bridge portion resiliently connecting the stationary portion to the movable portion.

17. The latching mechanism as claimed in claim 16, wherein the movable portion resiliently pivots around the stationary portion during operation of the latch mechanism, and wherein the movable portion includes at least one latch configured to couple the cable assembly to a metal cage housing a mating connector.

18. A latching mechanism comprising:

a pull tab slidably positioned outside a cable housing of a cable assembly; and a latch frame connected to the pull tab and the cable housing and integrally including a stationary portion disposed inside the cable housing and at least one movable latch disposed outside the housing and configured to couple the cable assembly to a metal cage housing a mating connector, such that a top side of the housing is disposed between the pull tab and the stationary portion of the latch frame.

19. The latching mechanism as claimed in claim 18, wherein the pull tab includes a connection portion configured to connect the pull tab to the latch frame and sized to be looped around a connection bar of the latch frame during assembly of the latch mechanism.

20. An electrical connector comprising an insulative body having a top, a bottom, a front face and a rear face;

a plurality of tongues, each tongue having a top tongue surface and a bottom tongue surface, extending from the front face in a direction away from the insulative body;

one set of terminals mounted in one set of tongue slots incorporateed at the top tongue surface of each tongue and another set of terminals mounted in another set of tongue slots incorporated at the bottom tongue surface of each tongue, wherein the tongue slots incorporated at the bottom tongue surface are aligned to the tongue slots incorporated at the top tongue surface, and a plurality of lateral slots in the insulative body configured to received at least one attachment device, wherein each lateral slot in the plurality of lateral slots corresponds to a tongue in the plurality of tongues and is disposed between the set of terminals mounted at the top tongue surface of the tongue and the set of terminals mounted at the bottom tongue surface of the tongue.

* * * * *